US011168476B1

(12) United States Patent
Tadros et al.

(10) Patent No.: US 11,168,476 B1
(45) Date of Patent: Nov. 9, 2021

(54) ULTRA HIGH PERFORMANCE CONCRETE VOIDED SLAB PANELS

(71) Applicant: e.Construct.USA, LLC, Omaha, NE (US)

(72) Inventors: Maher K. Tadros, Omaha, NE (US); Micheal Asaad, Omaha, NE (US); Bradley Schipper, Valley, NE (US)

(73) Assignee: e.Construct.USA, LLC, Omaha, NE (US)

( * ) Notice: Subject to any disclaimer, the term of this patent is extended or adjusted under 35 U.S.C. 154(b) by 0 days.

(21) Appl. No.: 16/802,183

(22) Filed: Feb. 26, 2020

Related U.S. Application Data

(60) Provisional application No. 62/810,568, filed on Feb. 26, 2019.

(51) Int. Cl.
*E04B 5/04* (2006.01)
*E04B 5/48* (2006.01)

(52) U.S. Cl.
CPC ..... *E04B 5/043* (2013.01); *E04B 5/48* (2013.01)

(58) Field of Classification Search
CPC ..... E04B 5/043; E04B 5/48
See application file for complete search history.

(56) References Cited

U.S. PATENT DOCUMENTS 5,317,846 A * 6/1994 Michlovic ..... E04B 5/40 52/220.2
8,919,057 B1 * 12/2014 Dupray ..... E04B 5/36 52/223.14
2003/0097806 A1 * 5/2003 Brown ..... E04B 5/04 52/220.1
2009/0064617 A1 * 3/2009 Montoya ..... E04B 5/043 52/309.12
2016/0355439 A1 * 12/2016 McCandlish ..... C04B 28/188
2017/0058517 A1 * 3/2017 Mohle ..... E04B 1/003
2017/0218614 A1 * 8/2017 Ciuperca ..... E04G 17/0658

* cited by examiner

*Primary Examiner* — Brian Handville
(74) *Attorney, Agent, or Firm* — Suiter Swantz pc llo

(57) ABSTRACT

An ultra high performance concrete (UHPC) voided slab panel may include a top slab including a top skin and a bottom slab including a bottom skin. The top slab and the bottom slab may be joined at a joint filled with a joint material and positioned a select height within the UHPC voided slab panel. The top slab and the bottom slab may be joined via a connector assembly. The panel may include least two ribs defining at least one void accessible via at least one opening through an exterior surface of the UHPC voided slab panel. The UHPC voided slab panel may be fabricated from UHPC and a plurality of embedded prestressing strands, and may be configured to meet select strength requirements that are greater than select strength requirements for conventional precast concrete without reinforcing bars being embedded within the UHPC voided slab panel.

20 Claims, 15 Drawing Sheets

ULTRA HIGH PERFORMANCE CONCRETE VOIDED SLAB PANELS

CROSS-REFERENCE TO RELATED APPLICATIONS

The present application claims the benefit under 35 U.S.C. § 119(e) of U.S. Provisional Patent Application Ser. No. 62/810,568, filed Feb. 26, 2019, titled ULTRA HIGH PERFORMANCE CONCRETE VOIDED SLAB SYSTEM, naming Maher K. Tadros, Micheal Asaad, and Bradley L. Schipper as inventors, which is incorporated herein by reference in the entirety.

TECHNICAL FIELD

The present invention generally relates to the field of concrete panels and, more particularly, to ultra high performance concrete voided slab panels.

BACKGROUND

Select residential and commercial structures are supported, at least in part, by parking structures positioned underneath the floors reserved for living, office, retail, and/or storage. Due to spacing constraints caused by accommodating vehicle operation and parking within the parking structure, the parking structure may be constructed from slabs. For example, parking structures may include slabs with a sixty-foot span, which includes two eighteen-foot parking areas and a twenty-four-foot, two-way aisle. For instance, slab systems that do not allow for a clear span of sixty feet include intermediate columns that are obstructions and a safety hazard to the individuals wishing the park their vehicles. in addition, slab systems that would allow for a clear span of sixty feet without intermediate columns require a structural floor depth much greater that the depth allowed for such floor. These slabs may be supported by walls or large columns which may be spaced further apart than the load-bearing walls of the above floors, such that the load-bearing walls of the above floors are denser, or more closely spaced. This, in turn, may cause conflicts in the building plans for the select residential and commercial structures.

SUMMARY

An ultra high performance concrete (UHPC) voided slab panel is disclosed, in accordance with one or more embodiments of the disclosure. The panel may include a top slab including a top skin and a bottom slab including a bottom skin. The top slab and the bottom slab may be joined at a joint positioned a select height within the UHPC voided slab panel. The joint may be filled with a joint material during the joining of the top slab and the bottom slab. The top slab and the bottom slab may be joined via a connector assembly. The panel may include least two ribs. The at least two ribs may define at least one void. The at least one void may be accessible via at least one opening through an exterior surface of the UHPC voided slab panel. The UHPC voided slab panel may be fabricated from UHPC and a plurality of embedded prestressing strands, The UHPC voided slab panel may be configured to meet select strength requirements that are greater than select strength requirements for conventional precast concrete without reinforcing bars being embedded within the UHPC voided slab panel.

In some embodiments, the at least one void may be configured to house one or more utility components, the one or more utility components being configured to transfer one or more utilities through the UHPC voided slab panel.

In some embodiments, the at least one void may be accessible via at least one opening within an exterior span surface of the UHPC voided slab panel or via at least one opening within an exterior width surface of the UHPC voided slab panel.

In some embodiments, the at least one void may include a first void accessible via at least one opening within a span surface of a span of the UHPC voided slab panel and a second void accessible via at least one opening within a width surface of the UHPC voided slab panel.

In some embodiments, the select height being at mid-depth of the UHPC voided slab panel, a first portion of each of the at least two ribs being formed with the top slab and a corresponding second portion of each of the at least two ribs being formed with the bottom slab.

In some embodiments, the first portion of each of the at least two ribs and the corresponding second portion of each of the at least two ribs may be coupled together via the connector assembly. The connector assembly may include a keyed assembly with a male keyed structure and a female keyed structure. The male keyed structure may be configured to interlock with the female keyed structure. The male keyed structure may be configured to pass through a plane when interlocking with the female keyed structure. The plane may be at mid-depth of the UHPC voided slab panel.

In some embodiments, a first portion of a first rib of the at least two ribs may include a male keyed structure and a corresponding second portion of the first rib of the at least two ribs may include a corresponding female keyed structure. A first portion of a second rib of the at least two ribs including a female keyed structure and a corresponding second portion of the second rib of the at least two ribs may include a corresponding male keyed structure.

In some embodiments, the select height may be proximate to the top slab of the UHPC voided slab panel.

In some embodiments, the at least two ribs may be formed with the bottom slab.

In some embodiments, the top slab may include a first component of the connector assembly. The at least two ribs may be formed with the bottom slab including a second component of the connector assembly.

In some embodiments, the select height may be proximate to the bottom slab of the UHPC voided slab panel.

In some embodiments, the at least two ribs may be formed with the top slab.

In some embodiments, the bottom slab may include a first component of the connector assembly. The at least two ribs formed with the top slab may include a second component of the connector assembly.

In some embodiments, the connector assembly may include at least one rod in the bottom slab and at least one hole in the top slab. The at least one hole may be configured to receive the at least one rod when the top slab and the bottom slab are joined.

In some embodiments, the at least one rod may be configured to be inserted within the at least two ribs.

An ultra high performance concrete voided slab system is disclosed, in accordance with one or more embodiments of the disclosure. The system may include a plurality of ultra high performance concrete (UHPC) voided slab panels. Each UHPC voided slab panel of the plurality of UHPC voided slab panels may include a top slab including a top skin and a bottom slab including a bottom skin. The top slab and the bottom slab may be joined at a joint positioned a select height within the UHPC voided slab panel. The joint may be filled with a joint material during the joining of the top slab and the bottom slab. The top slab and the bottom slab may be joined via a connector assembly. Each UHPC voided slab panel of the plurality of UHPC voided slab panels may include least two ribs. The at least two ribs may define at least one void. The at least one void may be accessible via at least one opening within an exterior surface of the UHPC voided slab panel. The UHPC voided slab panel may be fabricated from UHPC and a plurality of embedded prestressing strands. The UHPC voided slab panel may be configured to meet select strength requirements that are greater than select strength requirements for conventional precast concrete without reinforcing bars being embedded within the UHPC voided slab panel.

In some embodiments, each UHPC voided slab panel of the plurality of UHPC voided slab panels may include a span edge on at least one of the top slab or the bottom slab. Adjacent UHPC voided slab panels of the plurality of UHPC voided slab panels may be couplable together via adjacent span edges of the adjacent UHPC voided slab panels.

A method is disclosed, in accordance with one or more embodiments of the present disclosure. The method may include, but is not limited to, fabricating a top slab of an ultra high performance concrete (UHPC) voided slab panel with a top formwork. Fabricating the top slab may include pouring a first amount of UHPC within at least two rib portions to fabricate at least two ribs. The space between the at least two ribs may define at least one void. Fabricating the top slab may include pouring a second amount of UHPC within at least one skin portion to fabricate a top skin. The top formwork may include a plurality of prestressing strands positioned to be embedded during the pouring of the at least one of the first amount of UHPC or during the pouring of the second amount of UHPC. The method may include, but is not limited to, fabricating a bottom slab of the UHPC voided slab panel with a bottom formwork. The fabricating the bottom slab may include pouring a first amount of UHPC within at least two ribs portion to fabricate at least two ribs. The space between the at least two ribs may define at least one void. The fabricating the bottom slab may include pouring a second amount of UHPC within at least one skin portion to fabricate a bottom skin. The bottom formwork may include a plurality of prestressing strands positioned to be embedded during the pouring of the at least one of the first amount of UHPC or during the pouring of the second amount of UHPC. The method may include, but is not limited to, joining the top slab of the UHPC voided slab panel and the bottom slab of the UHPC voided slab panel together via a connector assembly. The joint may be filled with a joint material during the joining of the top slab and the bottom slab. The UHPC voided slab panel may be configured to meet select strength requirements that are greater than select strength requirements for conventional precast concrete without reinforcing bars being embedded within the UHPC voided slab panel.

In some embodiments, the method may include, but is not limited to, installing one or more utility components within the at least one void. The one or more utility components may be configured to transfer one or more utilities through the UHPC voided slab panel.

In some embodiments, the top formwork and the bottom formwork may be a single formwork. The top slab may be fabricated before the bottom slab. The fabricated top slab may be removed from the single formwork prior to the fabricating of the bottom slab.

This Summary is provided solely as an introduction to subject matter that is fully described in the Detailed Description and Drawings. The Summary should not be considered to describe essential features nor be used to determine the scope of the Claims. Moreover, it is to be understood that both the foregoing Summary and the following Detailed Description are examples and explanatory only and are not necessarily restrictive of the subject matter claimed.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Figure 1A:
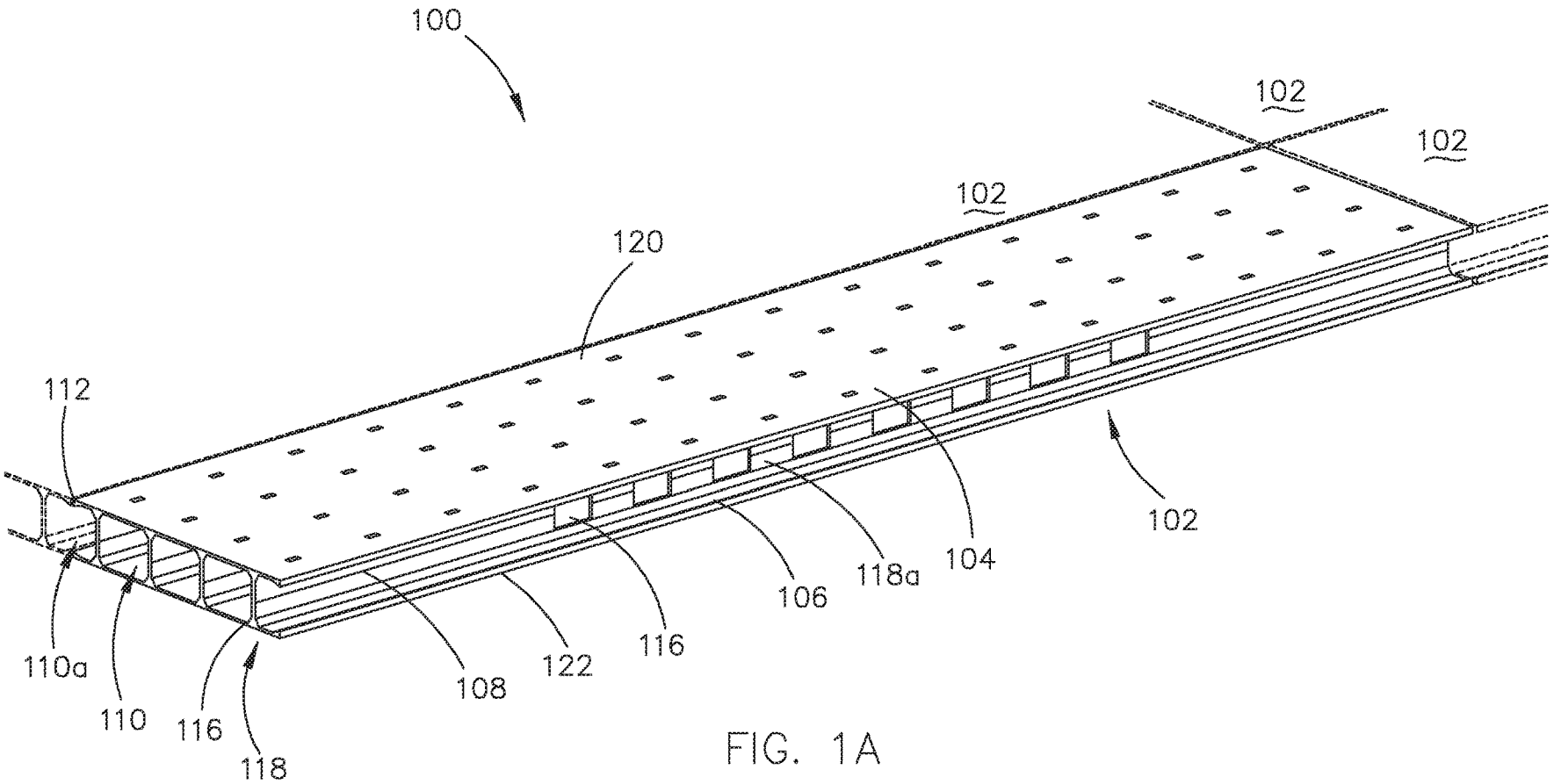
FIG. 1A illustrates a perspective view of an ultra high performance concrete (UHPC) voided slab system including a set of ultra high performance concrete (UHPC) voided slab panels, in accordance with one or more embodiments of the disclosure.

Reference will now be made in detail to the subject matter disclosed, which is illustrated in the accompanying drawings.

Referring in general to FIGS. 1A-10, ultra high performance concrete voided slab panels are described, in accordance with one or more embodiments of the disclosure.

Embodiments of the disclosure are directed to an ultra high performance concrete (UHPC) voided slab system including one or more ultra high performance concrete (UHPC) voided slab panels, where a voided slab panel includes a top slab and a bottom slab, where one or more voids are formed between the top slab and the bottom slab. Embodiments of the disclosure are also directed to prestressing strands (or cables) embedded longitudinally in the top slab and/or the bottom slab to ensure adequate flexural (e.g., bending) capacity of the UHPC voided slab system. Embodiments of the disclosure are also directed to using steel fibers instead of rebar and/or shearing reinforcements, resulting in a system that is easier to manufacture and is thinner than conventional concrete slabs.

The ultra high performance concrete (UHPC) as described and used in the disclosure may be fabricated by mixing steel fibers including a powder mixture including silica fume. For example, the steel fibers may be approximately 0.2 millimeters (mm) in diameter, and may range from twelve to twenty millimeters in length. The steel fibers and the powder mixture may be mixed so as to ensure a desired level of consistency/uniformity within the UHPC. The steel fibers and the powder mixture may be mixed so as to ensure a random orientation of the steel fibers within the UHPC.

The steel fibers may make up a select percentage of the total volume of the UHPC as described and used in the disclosure. For example, the steel fibers may be approximately two percent by total volume. It is noted herein, however, that the formula for determining the correct percentage of steel fibers with respect to total volume may be dependent on a select loading density and/or a select span capacity of the UHPC voided slab panels of the UHPC voided slab system.

The UHPC as described and used in the disclosure may have select strength requirements that are superior to the select requirements of conventional precast concrete. For example, the compressive strength of the UHPC may be approximately 18,000 pounds per square inch (psi), versus 5,000 psi for conventional concrete. By way of another example, the tensile strength of the UHPC may be approximately 2,500 psi, versus 500 psi for conventional concrete. It is noted herein that the increased strength requirements may allow for the UHPC voided slab system to have UHPC voided slab panels with a clear sixty-foot span in all floors above a parking structure. In addition, it is noted herein that UHPC is a term coined by the Federal Highway Administration, which has separate requirements for compressive strength (e.g., 21,300 psi) and tensile strength (e.g., 720 psi) than that of the UHPC as described and used in the disclosure.

Select conventional precast concrete slabs may utilize one or more of rebar and/or shearing reinforcements to meet or exceed desired strength requirements. In contrast to those select conventional precast concrete slabs, voided slabs generated from the UHPC as described and used in the disclosure may not utilize any additional support components (e.g., reinforcing bars, or the like) beyond the steel fibers combined with the powder mixture and any prestressing stands embedded longitudinally in the voided slabs. In this regard, voided slabs fabricated from the UHPC as used and described in the disclosure may be lighter, may be of a thinner thickness, and/or may require less material quantities than the select conventional precast concrete slabs, resulting in a stronger concrete slab that is easier to manufacture and transport than the select conventional precast concrete slabs.

Figure 1B:
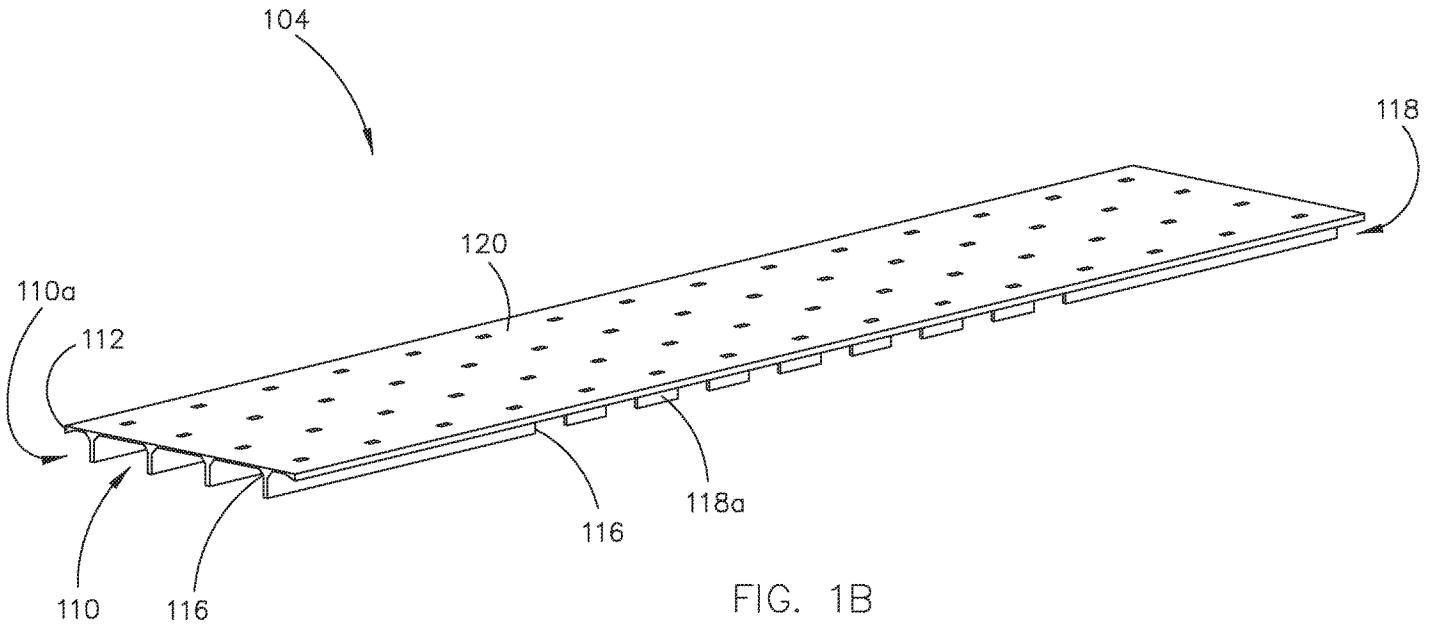
FIG. 1B illustrates a perspective view of a top slab of an ultra high performance concrete (UHPC) voided slab panel, in accordance with one or more embodiments of the disclosure.
Figure 1C:
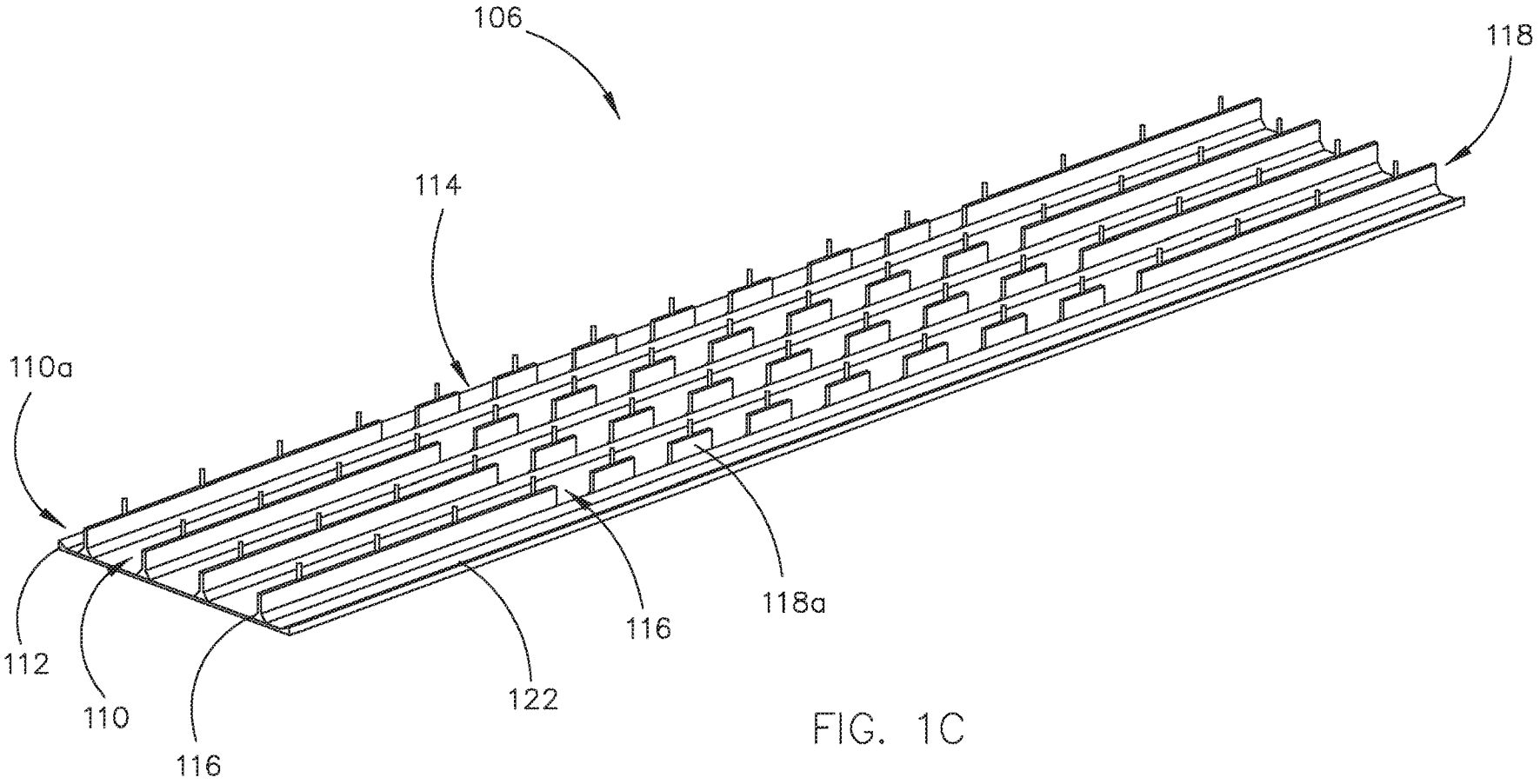
FIG. 1C illustrates a perspective view of a bottom slab of an ultra high performance concrete (UHPC) voided slab panel, in accordance with one or more embodiments of the disclosure.

FIGS. 1A-1C generally illustrate perspective views of one or more ultra high performance concrete (UHPC) voided slab panels 102 of an ultra high performance concrete (UHPC) voided slab system 100, in accordance with one or more embodiments of the disclosure. The UHPC voided slab panel 102 may be fabricated from a top slab 104 (e.g., as illustrated in FIG. 1B) and a bottom slab 106 (e.g., as illustrated in FIG. 1C), where the top slab 104 and the bottom slab 106 are joined or coupled together at a joint 108. In one example, the UHPC voided slab panel 102 as illustrated in FIGS. 1A-1C may measure in at 60 feet in length/span by 12 feet in width by 22 inches in height/thickness. It is noted herein, however, that the UHPC voided slab panel 102 is not limited to the provided dimensions, but may instead be a set of any dimensions. Therefore, the above description should not be interpreted as a limitation on the scope of the disclosure but merely an illustration.

The UHPC voided slab panel 102 may have one or more voids or pockets 110 accessible via one or more openings 116 through an exterior surface of the UHPC voided slab panel 102. The one or more voids or pockets 110 may allow for utilities to be installed within the UHPC voided slab panel 102 (e.g., installed within the floor above a parking structure, where the UHPC voided slab panel 102 forms a ceiling surface of the parking structure).

The UHPC voided slab panel 102 may include any number of voids 110 (e.g., 1, 2, up to an N number of voids 110) that pass longitudinally through the span of the UHPC voided slab panel 102, where the voids 110 may be separated by one or more ribs 118. For example, the span of the UHPC voided slab panel 102 may include three voids 110. For instance, the three voids 110 may be spaced at 3 feet (e.g., the ribs 118 are spaced 3 feet apart from center), such that the outer ribs 118 are 18 inches from the edge of the UHPC voided slab panel 102. The number of voids 110 through the span of the UHPC voided slab panel 102 and the width of the ribs 118 through the span of the UHPC voided slab panel 102 may be inter-related. For example, the voids 110 through the span of the UHPC voided slab panel 102 may be wider where the ribs 118 between the voids 110 are wider. It is noted herein that this may allow for a thinner skin of the UHPC voided slab panel 102 (e.g., a top skin 120 of the top slab 104 of the UHPC voided slab panel 102 and/or a bottom skin 122 of the bottom slab 106 of the UHPC voided slab panel 102).

It is noted herein that the UHPC voided slab panel 102 may include a void portion 110*a* at each of its two span edges 112. In this regard, UHPC voided slab panels 102 with adjacent span edges 112 may generate and share a full void 110 via the combining of the respective void portions 110*a*. For example, two adjacent UHPC voided slab panels 102 may have a combined seven voids 110 across a combined width. It is noted herein that the UHPC voided slab system 100 may include adjacent UHPC voided slab panels 102 spaced ½-inch apart when installed in residential and commercial structures.

The UHPC voided slab panel 102 may have one or more voids or pockets 114 accessible via one or more openings 116 through an exterior surface of the UHPC voided slab panel 102. The one or more voids or pockets 114 may allow for utilities to be installed within the UHPC voided slab panel 102 (e.g., installed within the floor above a parking structure, where the UHPC voided slab panel 102 forms a ceiling surface of the parking structure).

The UHPC voided slab panel 102 may include any number of voids 114 (e.g., 1, 2, up to an N number of voids 114) through the width of the UHPC voided slab panel 102, such that the ribs 118 through the span of the UHPC voided slab panel 102 are segmented into rib sections 118*a*. For example, the span of the UHPC voided slab panel 102 may include eight voids 114. For instance, the eight voids 114 may be spaced at four feet (e.g., the rib sections 118*a* are spaced 4 feet apart from center), while the voids 114 themselves may be 2 feet long. The number of voids 114 through the width of the UHPC voided slab panel 102 and the length of the rib sections 118*a* through the width of the UHPC voided slab panel 102 may be inter-related. For example, the voids 114 through the width of the UHPC voided slab panel 102 may be longer where the rib sections 118*a* between the voids 114 are longer. It is noted herein that this may allow for a thinner thickness of skin of the UHPC voided slab panel 102 (e.g., the top skin 120 of the top slab 104 of the UHPC voided slab panel 102 and/or the bottom skin 122 of the bottom slab 106 of the UHPC voided slab panel 102).

It is noted herein that a select distance from each end of the UHPC voided slab panel 102 may not include any voids 114 through the width of the UHPC voided slab panel 102 in order to preserve a select amount of shearing performance (e.g., the UHPC voided slab panel 102 may include a solid ribbed portion and a voided ribbed portion). For example, where the span of the UHPC voided slab panel 102 is sixty feet, the first and last twelve feet of the UHPC voided slab panel 102 may not include any voids 114 through the width of the UHPC voided slab panel 102. In addition, where the span of the UHPC voided slab panel 102 is 48 feet, the first 8 feet and the last 8 feet may not include any voids 114 through the width of the UHPC voided slab panel 102. In general, the first and last twenty percent of the UHPC voided slab panel 102 may not include any voids 114 through the width of the UHPC voided slab panel 102.

It is noted herein that the UHPC voided slab panel 102 may not be limited to the three voids 110 through the span of the UHPC voided slab panel 102 and/or the eight voids 114 through the width of the UHPC voided slab panel 102, as illustrated in FIGS. 1A-1C. Therefore, the above description should not be interpreted as a limitation on the scope of the disclosure but merely an illustration.

FIGS. 2A-9C generally illustrate a novel and highly efficient method or process for manufacturing the UHPC voided slab panel 102, in accordance with one or more embodiments of the disclosure.

Figure 2A:
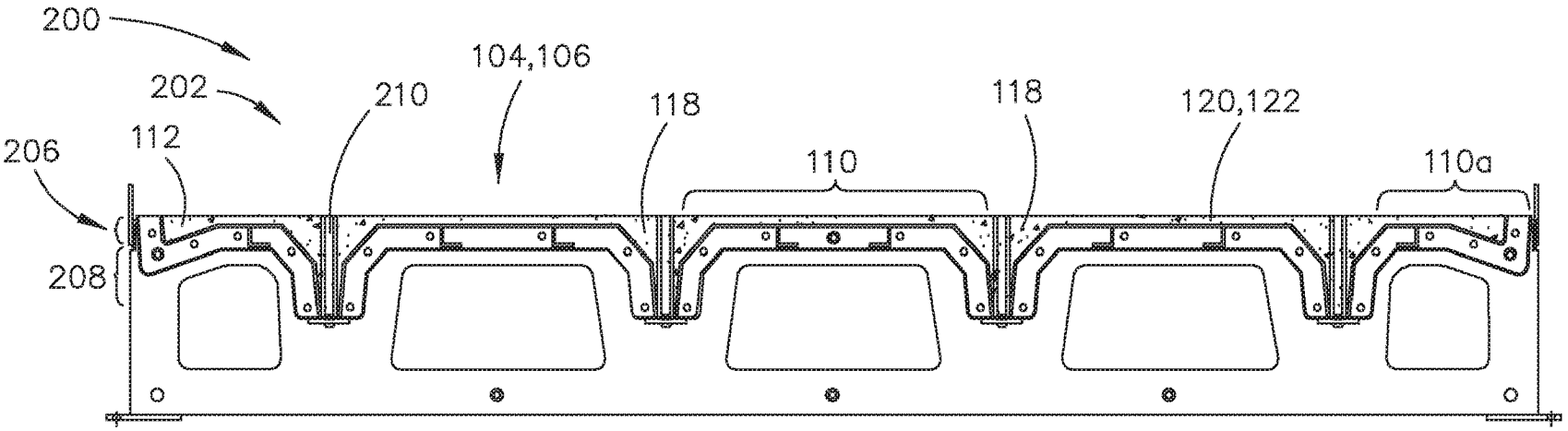
FIG. 2A illustrates an elevation view of a solid ribbed portion of a formwork for a top slab or a bottom slab of an ultra high performance concrete (UHPC) voided slab panel, in accordance with one or more embodiments of the disclosure.
Figure 2B:
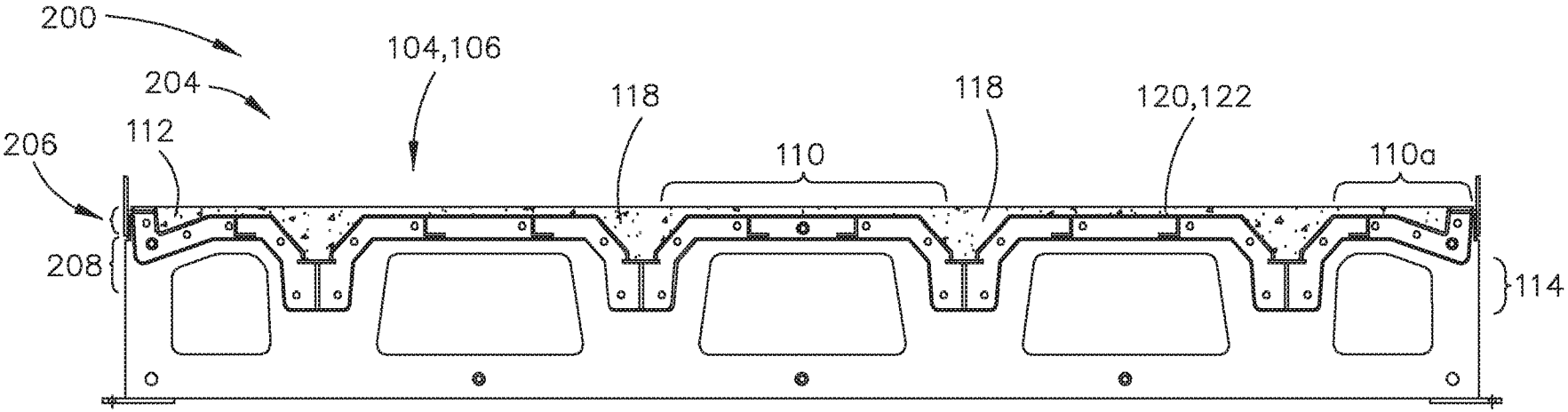
FIG. 2B illustrates an elevation view of a voided ribbed portion of a formwork for a top slab or a bottom slab of an ultra high performance concrete (UHPC) voided slab panel, in accordance with one or more embodiments of the disclosure.

FIGS. 2A and 2B illustrate portions of a formwork 200, in accordance with one or more embodiments of the disclosure. The formwork 200 may be used to form the top slab 104 or the bottom slab 106. The formwork 200 may be laid on the ground or manufacturing floor. The formwork 200 may rest on a flat steel pallet. The formwork 200 may include a lifting hook to re-position the formwork 200 (e.g., on the ground or manufacturing floor). The formwork 200 may be fabricated from a ⅜-inch steel plate skin. The formwork 200 may include a ¼-inch steel stiffener with a four-foot spacing across the twelve-foot width, with voids 110 being formed between the ¼-inch steel stiffeners. A steel yoke at a four-foot spacing may rest on top of (e.g., either loosely or be coupled to) the formwork 200.

As illustrated in FIG. 2A, the formwork 200 may include one or more solid ribbed portions 202. For example, the one or more solid ribbed portions 202 may be configured to create the one or more voids 110.

As illustrated in FIG. 2B, the formwork 200 may include one or more voided ribbed portions 204. For example, the one or more voided ribbed portions 204 may be configured to create the one or more voids 110 and the one or more voids 114.

As illustrated in FIGS. 2A and 2B, the formwork 200 may include a skin portion 206 configured to form the top skin 120 and/or the bottom skin 122. By way of another example, the formwork 200 may include a rib portion 208 configured to form the one or more ribs 118. It is noted herein the one or more voids 110, 114 may be formed between the one or more ribs 118 by the absence of the UHPC in select areas defined by the formwork 200.

The sides of the rib portion 208 may be tapered to allow for removal of the top slab 104 and/or the bottom slab 106 from the formwork 200, following the placing of the UHPC. For example, the sides of the rib portion 208 may be dimensioned such that the top of the ribs 118 (e.g., the portion near the top skin 120 of the top slab 104 and/or the portion near the bottom skin 122 of the bottom slab 106) may be 26 inches in length, while the bottom of the ribs 118 (e.g., the portion near the mid-depth of the UHPC voided slab panel 102) may be 24 inches in length. By way of another example, the sides of the rib portion 208 may be dimensioned such that the top of the voids 110, 114 (e.g., the top skin 120 of the top slab 104 and/or the portion near the bottom skin 122 of the bottom slab 106) may be 22 inches in length, while the bottom of the voids 110, 114 (e.g., the portion near the mid-depth of the UHPC voided slab panel 102) may be 24 inches in length.

The formwork 200 may include a ⅜-inch by 3-inch horizontal stiffener flanking each side of each void between the ¼-inch steel stiffeners. The formwork 200 may include a 1-inch by 3-inch continuous shim along each side. The formwork 200 may include a 6-inch by 1-inch plastic plywood board, where the plastic plywood may be continuous down the middle. The plastic plywood board may include a ½-inch deep shear key cut. For instance, the shear key cut may be set at a 6-inch spacing.

It is noted herein that the formwork 200 illustrated in FIGS. 2A and 2B is only an example, and that the formwork 200 may be fabricated with cut-outs and/or dimensions that differ from those illustrated in FIGS. 2A and 2B. As such, the formwork 200 is not limited to the example as illustrated in FIGS. 2A and 2B. Therefore, the above description should not be interpreted as a limitation on the scope of the disclosure but merely an illustration.

Prestressing strands (or cables) may be laid within the formwork 200 and tensioned by being connected to an exterior mount outside of the formwork 200. For example, each rib of the top slab 104 and/or the bottom slab 106 may have two tensioned prestressing strands (or pre-tensioned, if the point of reference is the placing of UHPC in the formwork), and each span edge 112 and top skin 120 of the top slab 104 or each span edge 112 and bottom skin 122 of the bottom slab 106 may have one tensioned prestressing strand. It is noted herein, however, that the top slab 104 and/or the bottom slab 106 may include any number of tensioned prestressing strands within each rib 118, span edge 112, top skin 120, and/or bottom skin 122. Therefore, the above description should not be interpreted as a limitation on the scope of the disclosure but merely an illustration.

In the solid ribbed portion 202, one or more sleeves or blockouts 210 may be inserted through a top surface of the formwork 200. For example, the one or more sleeves or blockouts 210 may be fabricated from a foam, a plastic (e.g., polyurethane, or the like) or a metal (e.g., sheet metal, or the like). For instance, the sleeves or blockouts 210 may be removed following the placing and setting of the UHPC. By way of another example, the sleeves or blockouts 210 may remain within the slab 104 and/or the slab 106 following the placing and setting of the UHPC.

Figure 3A:
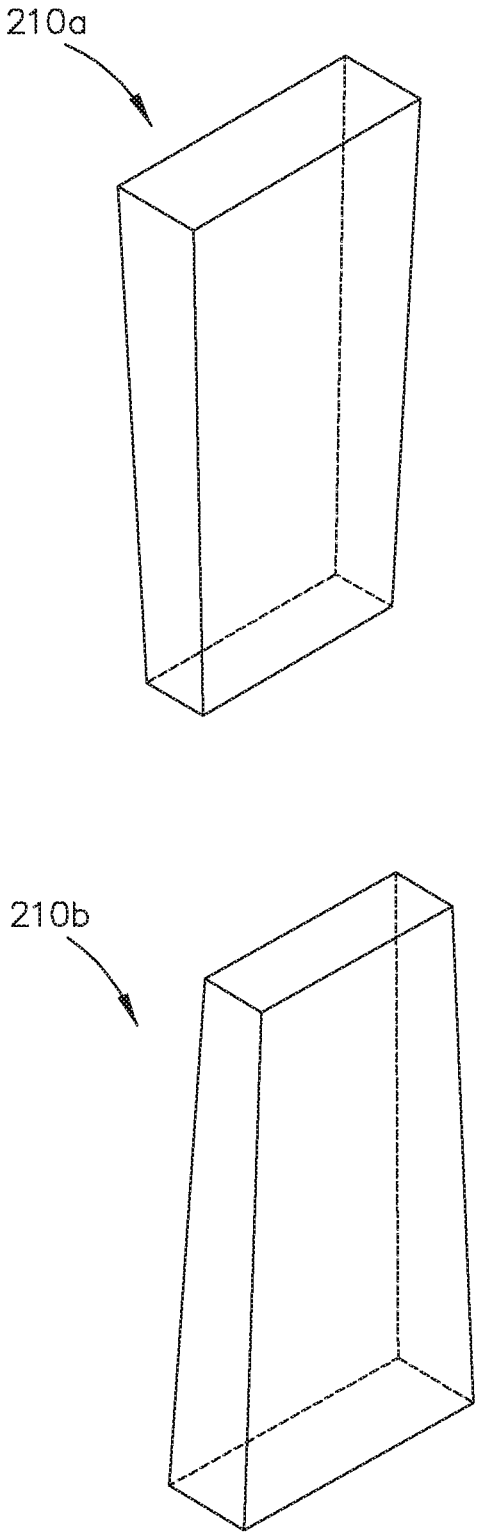
FIG. 3A illustrates a perspective view of a set of blockouts for a top slab and a bottom slab of an ultra high performance concrete (UHPC) voided slab panel, in accordance with one or more embodiments of the disclosure.
Figure 3B:
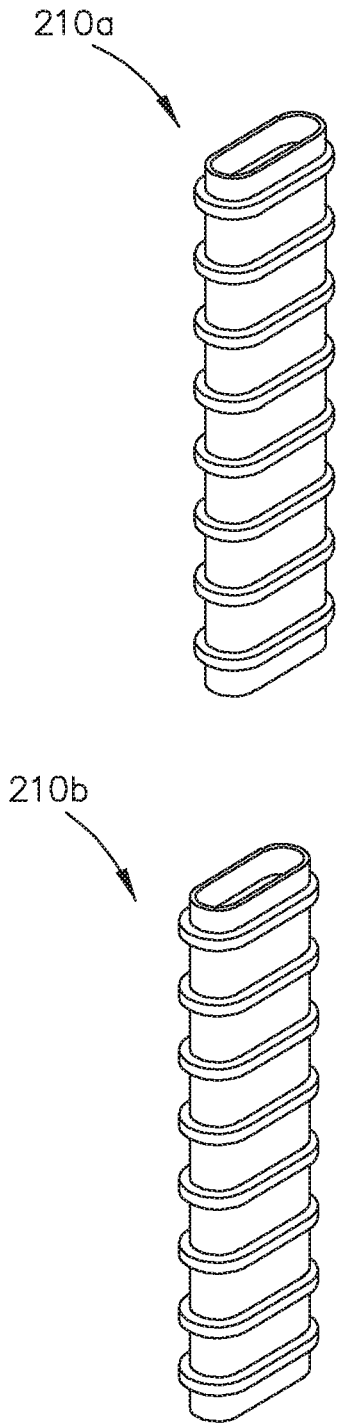
FIG. 3B illustrates a perspective view of a set of sleeves for a top slab and a bottom slab of an ultra high performance concrete (UHPC) voided slab panel, in accordance with one or more embodiments of the disclosure.

FIGS. 3A and 3B illustrate example embodiments of two types of sleeves or blockouts 210, in accordance with one or more embodiments of the disclosure.

As illustrated in FIG. 3A, the one or more sleeves or blockouts 210 may include a top blockout 210*a* and a bottom blockout 210*b*. The top blockout 210*a* and/or the bottom blockout 210*b* may be tapered, such that the dimension of the mid-depth opening is smaller than the dimensions of the top skin 120 and/or the bottom skin 122 opening. For example, the opening proximate to the top skin 120 and/or the bottom skin 122 may be 6 inches long by 2 inches wide, while the opening proximate to the mid-depth of the UHPC voided slab panel 102 may be 5 inches long by 1.5 inches wide. By way of another example, the thickness of the blockout 210*a* may be 11.5 inches (e.g., for a male keyed structure, described in detail further herein), while the thickness of the blockout 210*b* may be 10.375 inches (e.g., for a female keyed structure, described in detail further herein). In this regard, a hole generated by the blockout 210*a*, 210*b* may be tapered. It is noted herein the blockouts 210*a*, 210*b* may be removed from the top slab 104 and/or the bottom slab 106 following the placing and setting of the UHPC.

As illustrated in FIG. 3B, the one or more sleeves or blockouts 210 may include a top sleeve 210*a* and a bottom sleeve 210*b*. The top sleeve 210*a* and/or the bottom sleeve 210*b* may be corrugated. For example, the corrugations may be 3.5 inches long by 1.5 inches wide. By way of another example, the opening in the top skin 120 and/or the bottom skin 122, as well as the mid-depth of the UHPC voided slab panel 102, may be similar in dimension and smaller than the corrugations. By way of another example, the thickness of the sleeve 210*a* may be 11.5 inches (e.g., for the male keyed structure, described in detail further herein), while the thickness of the sleeve 210*b* may be 10.375 inches (e.g., for the female keyed structure, described in detail further herein). It is noted herein the sleeve 210*a*, 210*b* may be left in the top slab 104 and/or the bottom slab 106 following the placing and setting of the UHPC.

It is noted herein that the sleeves or blockouts 210*a*, 210*b* as illustrated in FIGS. 3A and 3B are only examples, and that the sleeves or blockouts 210*a*, 210*b* may be fabricated with dimensions that differ from those illustrated in FIGS. 3A and 3B. As such, the sleeves or blockouts 210*a*, 210*b* are not limited to the examples as illustrated in FIGS. 3A and 3B. Therefore, the above description should not be interpreted as a limitation on the scope of the disclosure but merely an illustration.

With the sleeves 210 in place, UHPC may be placed within the formwork 200. For example, the UHPC may be placed within the formwork 200 between the ¼-inch steel stiffeners to form the one or more ribs 118. It is noted herein that care may need to be taken to not get UHPC in the hollow sleeves 210 (e.g., within the solid ribbed portion 202 of the formwork 200). The sides of the rib portion 208 may be tapered to allow for removal of the top slab 104 and/or the bottom slab 106 from the formwork 200 once the UHPC is at least partially set. Each span edge 112 of the top slab 104 and/or the bottom slab 106 may be thicker than the remainder of the top skin 120 of the top slab 104 and/or the bottom skin 122 of the bottom slab 106 to allow space for connecting adjacent UHPC voided slab panels 102 (e.g., as illustrated in FIG. 1A).

After the one or more ribs 118 are formed from the placed UHPC, the top skin 120 of the top slab 104 and/or the bottom skin 122 of the bottom slab 106 may be formed from UHPC. For example, the top skin 120 of the top slab 104 and/or the bottom skin 122 of the bottom slab 106 may be approximately one inch in thickness. By way of another example (e.g., as illustrated by the formwork 200 in FIGS. 2A and 2B), the top skin 120 of the top slab 104 and/or the bottom skin 122 of the bottom slab 106 may have additional material at each span edge 112 with a quantity that is greater than approximately one inch in thickness. For instance, the quantity of additional material at each span edge 112 may increase from one inch to three inches over a six-inch run.

It is noted herein, however, that the one or more ribs 118 and the top skin 120 or bottom skin 122 may be formed simultaneously or substantially simultaneously. Therefore, the above description should not be interpreted as a limitation on the scope of the disclosure but merely an illustration.

The UHPC may be allowed to set, or at least cure to a select hardness (e.g., a not fully set state) that is still capable of transportation. Once the amount of curing has reached the select threshold, the prestressing strands may be cut to de-tension the top slab 104 and/or the bottom slab 106. The top slab 104 and/or the bottom slab 106 may be removed from the formwork 200, and can be stored until it is joined with a corresponding bottom slab 106 and/or top slab 104.

In the case of the bottom slab 106, it is noted herein the prestressing strands may not be cut until after the joining of the top slab 104. Therefore, the above description should not be interpreted as a limitation on the scope of the disclosure but merely an illustration.

FIGS. 4A-4D and 5 generally illustrate the UHPC voided slab panel 102, in accordance with one or more embodiments of the disclosure.

One or more keyed structures may be formed on the one or more ribs 118. The top slab 104 and/or the bottom slab 106 may include one or more male keyed structures 400 extruding from one or more surfaces 404 and/or one or more female keyed structures 402 cut into one or more surfaces 406. It is noted herein a male keyed structure 400 and a female keyed structure 402 may be considered components of a keyed assembly 408. It is noted herein the keyed assembly 408 may be considered a connector assembly, for purposes of the disclosure.

In general, the one or more male keyed structures 400 and the one or more female keyed structures 402 may include any respective cross-section configured to at least partially interlock.

For example, the one or more male keyed structures 400 may include a trapezoidal cross-section. The one or more male keyed structures 400 may be tapered, such that the such that the dimensions at mid-depth of the UHPC voided slab panel 102 are smaller than the dimensions at a select distance from the mid-depth. For example, the dimensions at mid-depth of the UHPC voided slab panel 102 may be 11 inches by 1.5 inches, while the dimensions at the select distance from mid-depth may be 11.5 inches by 1.75 inches, where the select distance is 0.5 inches.

By way of another example, the one or more female keyed structures 402 may include a trapezoidal cross-section. The one or more female keyed structures 402 may be tapered, such that the such that the dimensions at mid-depth of the UHPC voided slab panel 102 are larger than the dimensions at a select distance from the mid-depth. For example, the dimensions at mid-depth of the UHPC voided slab panel 102 may be 12 inches by 1.875 inches, while the dimensions at the select distance from mid-depth may be 11.5 inches by 1.625 inches, where the select distance is 0.625 inches.

Figure 4A:
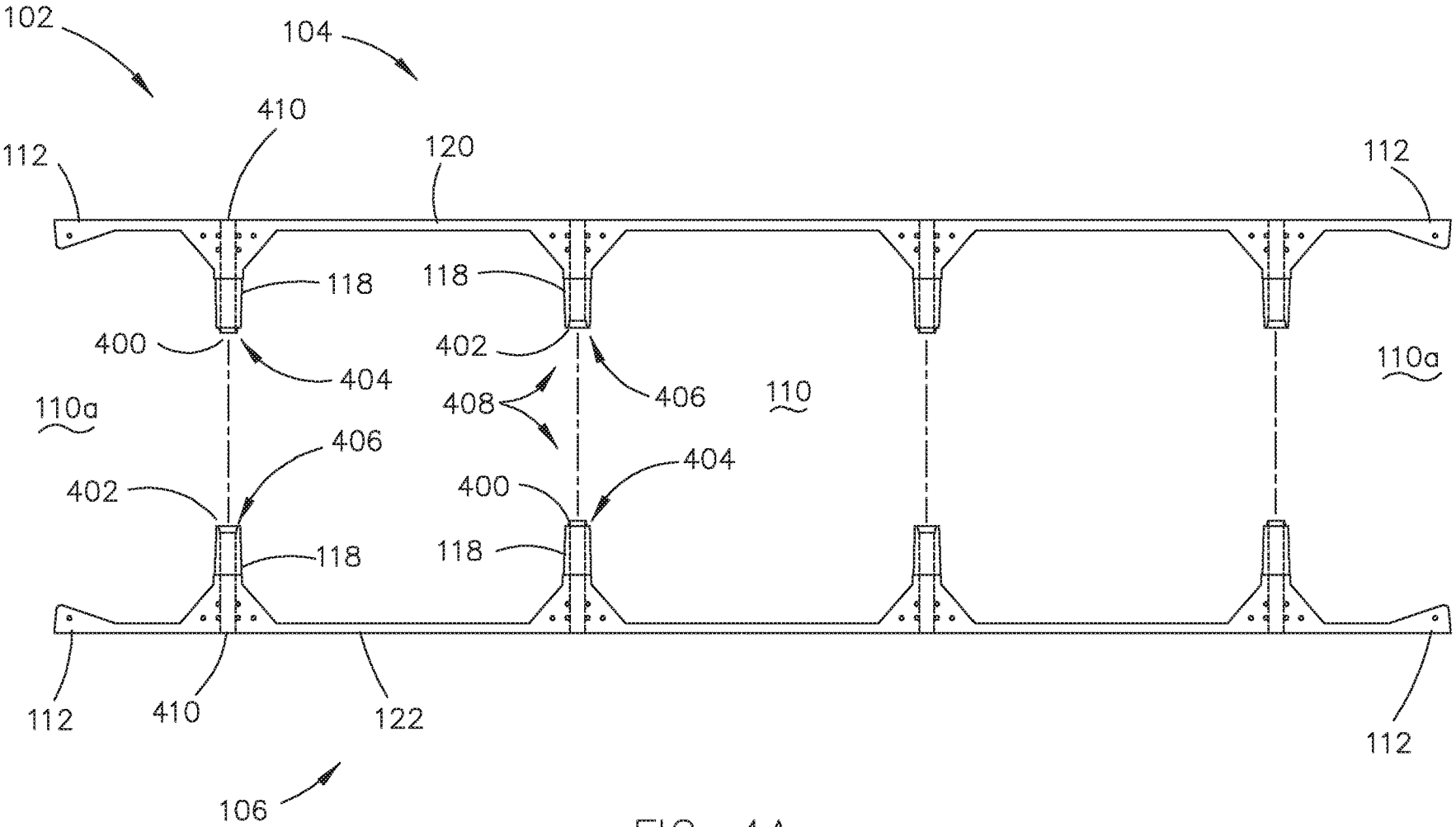
FIG. 4A illustrates a partial exploded view of an ultra high performance concrete (UHPC) voided slab panel, in accordance with one or more embodiments of the disclosure.
Figure 4B:
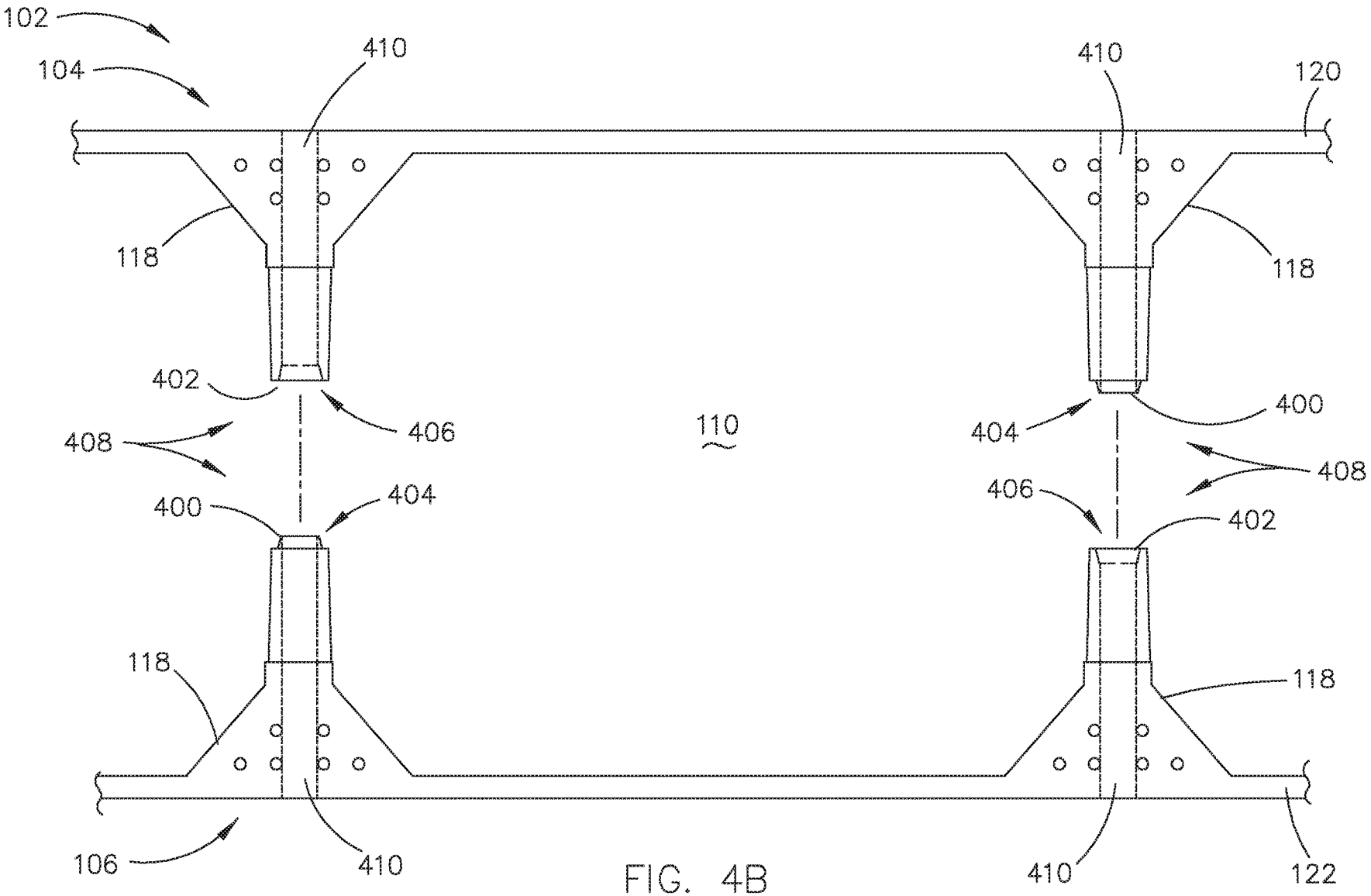
FIG. 4B illustrates a partial exploded view of an ultra high performance concrete (UHPC) voided slab panel, in accordance with one or more embodiments of the disclosure.
Figure 4D:
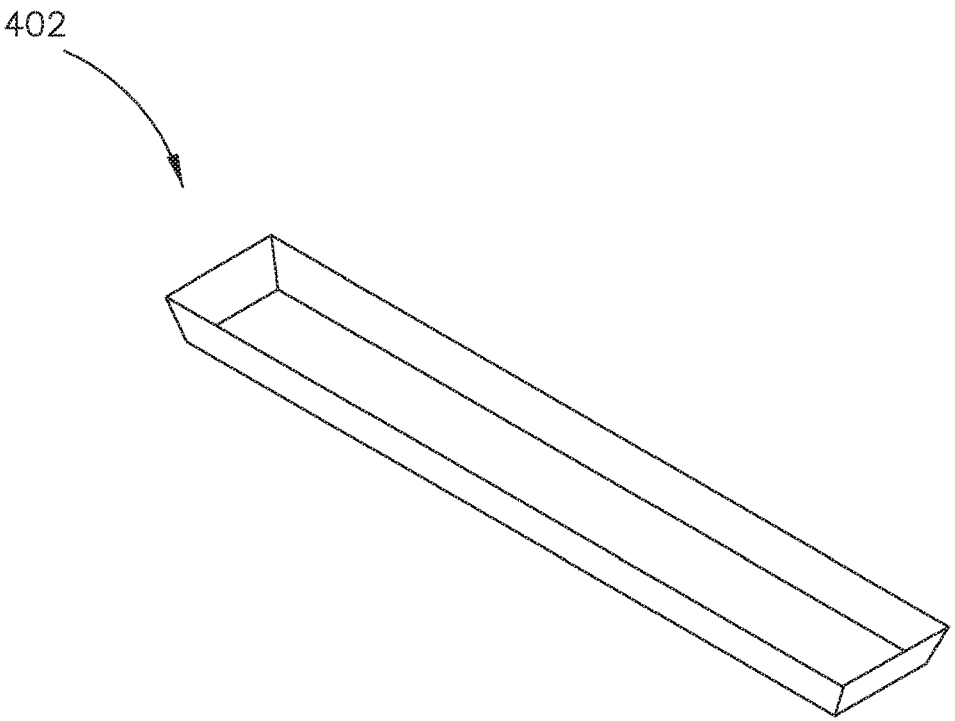
FIG. 4D illustrates a perspective view of a keyed structure of an ultra high performance concrete (UHPC) voided slab panel, in accordance with one or more embodiments of the disclosure.
Figure 4C:
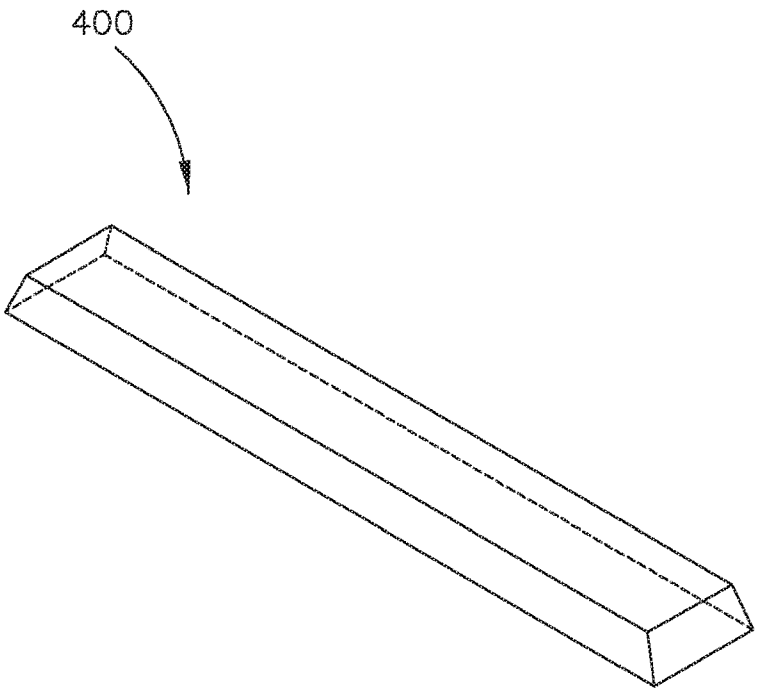
FIG. 4C illustrates a perspective view of a keyed structure of an ultra high performance concrete (UHPC) voided slab panel, in accordance with one or more embodiments of the disclosure.

It is noted herein that the male keyed structure 400 and the female keyed structure 402 as illustrated in FIGS. 4C and 4D are only examples, and that the male keyed structure 400 and the female keyed structure 402 may be fabricated with dimensions that differ from those illustrated in FIGS. 4C and 4D. As such, the male keyed structure 400 and the female keyed structure 402 are not limited to the examples as illustrated in FIGS. 4C and 4D. Therefore, the above description should not be interpreted as a limitation on the scope of the disclosure but merely an illustration.

Where the top slab 104 and the bottom slab 106 each include one or more male keyed structures 400 and one or more female keyed structures 402, the one or more male keyed structures 400 and the one or more female keyed structures 402 may be alternated within the one or more ribs 118. It is noted herein that alternating the one or more male keyed structures 400 and the one or more female keyed structures 402 may allow for the use of the single formwork 200 to manufacture both the top slab 104 and the bottom slab 106.

Although embodiments illustrate the top slab 104 and the bottom slab 106 including keyed structures 400, 402 configured to interlock when coupled together, it is noted herein the keyed structures 400, 402 are set within the one or more ribs 118 such that the joint 108 is a straight line at a same mid-depth height throughout (e.g., across the width and along the length/span) the UHPC voided slab panel 102. For example, the male keyed structures 400 may be configured to pass through a plane defined by the joint 108 and the surfaces 406, 408 when the top slab 104 and the bottom slab 106 are coupled together to interlock with corresponding female keyed structures 402, such that the plane is not altered by the points of interlocking and instead is the same mid-depth height throughout the UHPC voided slab panel 102. Therefore, the above description should not be interpreted as a limitation on the scope of the disclosure but merely an illustration.

Where a rib 118 includes a male keyed structure 400, the rib 118 may be 10.5 inches in total thickness and 10 inches in width. For example, the rib 118 (or a rib section 118*a*) may include a 0.5-inch thick male key structure 400 extended 0.5 inches into mid-depth, may change from 2.5 inches wide at mid-depth to 3 inches wide along a height of 5 inches from mid-depth, may have a section that is 3 inch wide by 1 inch thick, and may have a section that changes from 3 inches wide at 6 inches from mid-depth to 10 inches wide along a height of 5 inches between 5 inches and 10 inches from mid-depth.

Where a rib 118 includes a female keyed structure 402, the rib 118 may be 10 inches in total thickness and 10 inches in width. For example, the rib 118 (or a rib section 118*a*) may change from 2.5 inches wide at mid-depth to 3 inches wide along a height of 5 inches from mid-depth with a female keyed structures 402 cut into the rib 118 0.625 inches at mid-depth, may have a section that is 3 inch wide by 1 inch thick, and may have a section that changes from 3 inches wide at 6 inches from mid-depth to 10 inches wide along a height of 5 inches between 5 inches and 10 inches from mid-depth.

It is noted herein the combined thickness of the rib 118 and the top skin 120 may result in the top slab 104 or the bottom slab 106, respectively, to have a combined thickness of 11 inches (not counting the male keyed structures 400). As such, the mid-depth of the UHPC voided slab panel 102 may be positioned at a height of 11 inches.

It is noted herein that the one or more ribs 118 as illustrated in FIGS. 4A and 4B is only an example, and that the one or more ribs 118 may be fabricated with dimensions that differ from those illustrated in FIGS. 4A and 4B. As such, the bottom sleeve is not limited to the example as illustrated in FIGS. 4A and 4B. Therefore, the above description should not be interpreted as a limitation on the scope of the disclosure but merely an illustration.

Where the sleeves or blockouts 210 are removed following a setting of the UHPC, the top slab 104 and/or the bottom slab 106 may include one or more holes 410. Where the sleeves or blockouts 210 are left in following a setting of the UHPC, the sleeves or blockouts 210 may be at least partially hollow and include the one or more holes 410.

The one or more holes 410 may be configured to pass through the one or more ribs 118 and subsequently the pass through the one or more male keyed structures 400. The one or more holes 410 may be configured to pass through into the one or more female keyed structures 402 and subsequently pass through the one or more ribs 118.

Figure 5:
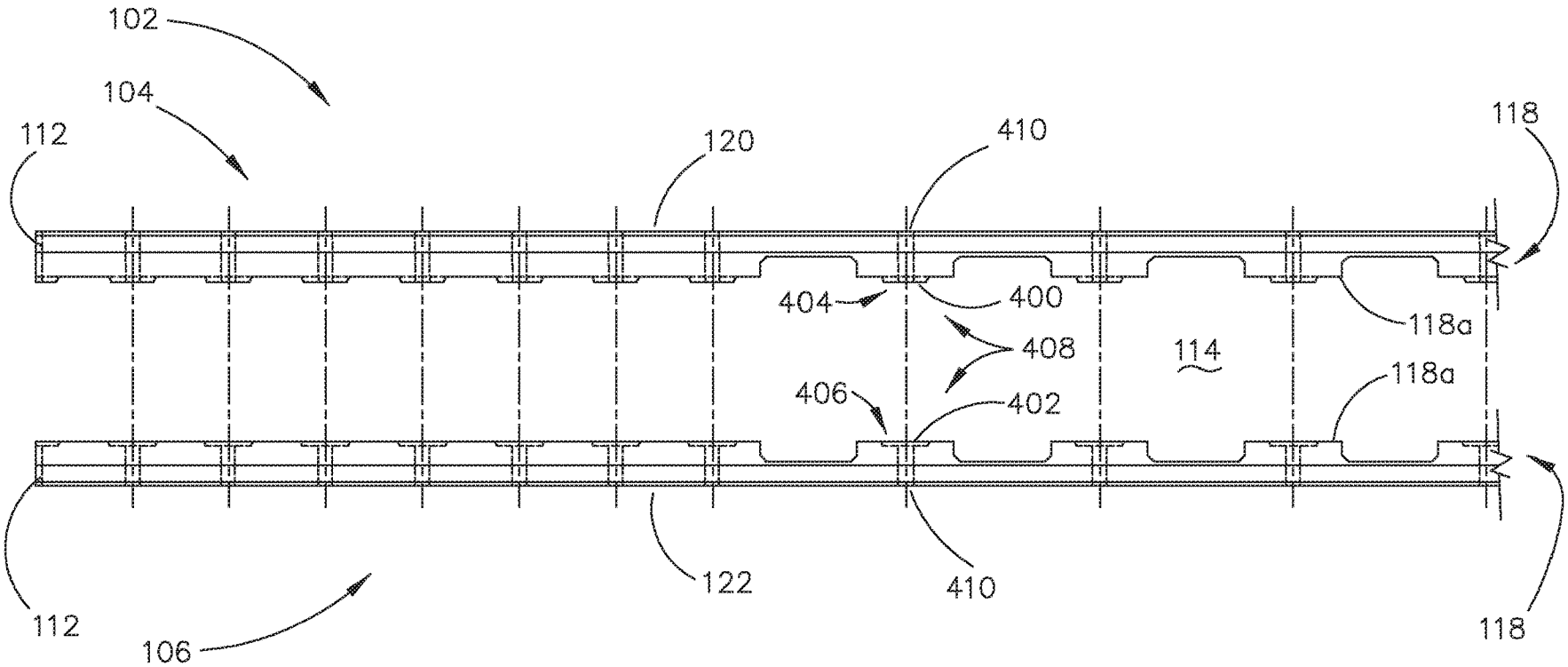
FIG. 5 illustrates a partial elevation view of an ultra high performance concrete (UHPC) voided slab panel, in accordance with one or more embodiments of the disclosure.

In one example, as illustrated in FIG. 5, a first section of the UHPC voided slab panel 102 may include a first set of the one or more holes 410 may be spaced 4 feet apart for 16 feet (e.g., a total of four holes 410) from a center of symmetry positioned midspan (e.g., 30 feet along the length/span of the UHPC voided slab panel 102). A second section of the UHPC voided slab panel 102 (e.g., defined from the end of the first section of the UHPC voided slab panel 102) may include a second set of the one or more holes 410 may be spaced 2 feet apart for 12 feet (e.g., meaning a total of six holes 410). A third section of the UHPC voided slab panel 102 (e.g., defined from the end of the second section of the UHPC voided slab panel 102) may include the remaining 2 feet of the 30-foot length from midspan.

It is noted herein that the positioning of the holes 410 as illustrated in FIG. 5 is only an example, and that the holes 410 may be positioned differently from those illustrated in FIG. 5. As such, the UPHC voided slab panel 102 is not limited to the example as illustrated in FIG. 5. Therefore, the above description should not be interpreted as a limitation on the scope of the disclosure but merely an illustration.

Figure 6:
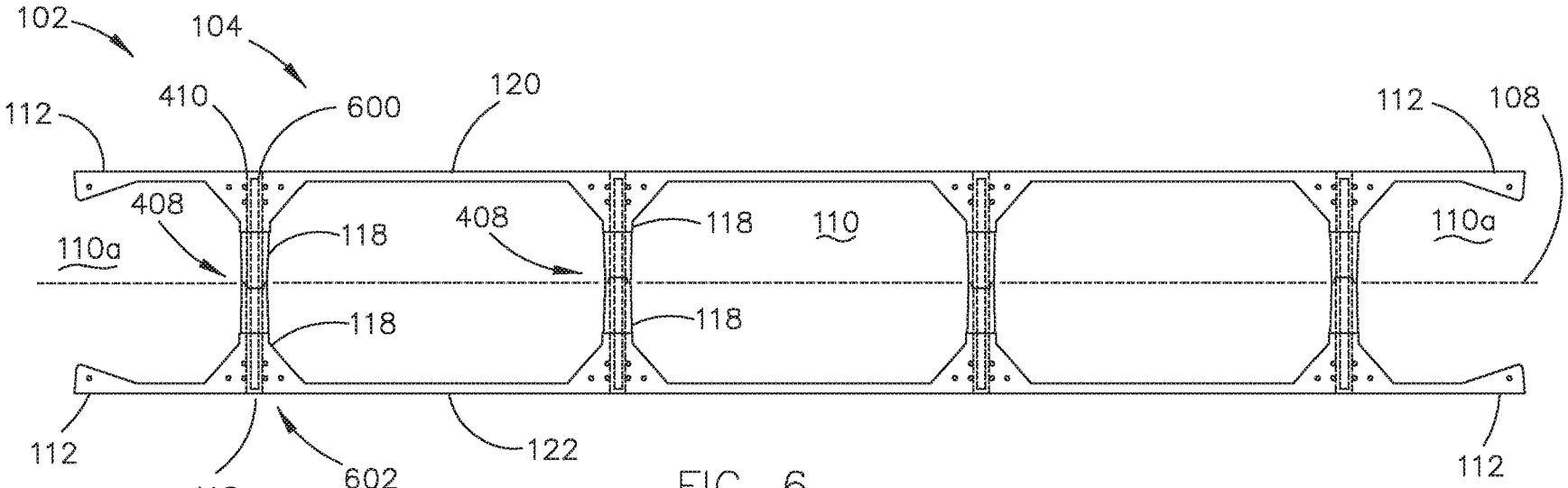
FIG. 6 illustrates an elevation view of an ultra high performance concrete (UHPC) voided slab panel, in accordance with one or more embodiments of the disclosure.

FIG. 6 illustrates the UHPC voided slab panel 102, in accordance with one or more embodiments of the disclosure.

One or more rods 600 may be secured within the formwork 200. For example, the one or more rods 600 may be secured with chairs, or the like. By way of another example, the one or more rods 600 may be threaded. The one or more rods 600 may be positioned in the bottom slab 106 (e.g., within the holes 410 in the bottom slab 106). The one or more rods 600 may be aligned with the holes 410 in the top slab 104. It is noted herein the rods 600 and the holes 410 (e.g., created by the removable sleeves or blockouts 210 or within the sleeves or blockouts 210) may be considered components of a connector assembly 602.

Where the bottom sleeves or blockouts 210*b* are left in the bottom slab 106, the bottom sleeves or blockouts 210*b* may be attached to each rod 600 at the top of the ribs 118 under each of the expected top sleeves or blockouts 210*a* located within the top slab 104.

Where the sleeves or blockouts 210*a*, 210*b* are removed from the UHPC voided slab panel 102, the holes 410 generated by the sleeves or blockouts 210*a*, 210*b* may be tapered to produce a wedging effect against the one or more rods 600 when the one or more rods 600 are inserted into the holes 410.

The one or more rods 600 may be a length allowing for a select amount of clearance from a top surface of the top skin 120 of the top slab 104 and/or a bottom surface of the bottom skin 122 of the bottom slab 106. For example, the clearance may be a 0.5-inch clearance. For instance, where the UHPC voided slab panel 102 is 22 inches thick, the one or more rods 600 may be 21 inches in length. The one or more rods 600 may be ¾-inch in diameter.

With the rods 600 secured, UHPC may be placed within the formwork 200. For example, the UHPC may be placed within the formwork 200 between the ¼-inch steel stiffeners to form the one or more ribs 118. It is noted herein that care may need to be taken to not get UHPC in the hollow sleeves 210 (e.g., within the solid ribbed portion 202 of the formwork 200). The sides of the rib portion 208 may be tapered to allow for removal of the top slab 104 and/or the bottom slab 106 from the formwork 200 once the UHPC is at least partially set. Each span edge 112 of the top slab 104 and/or the bottom slab 106 may be thicker than the remainder of the top skin 120 of the top slab 104 and/or the bottom skin 122 of the bottom slab 106 to allow space for connecting adjacent UHPC voided slab panels 102 (e.g., as illustrated in FIG. 1A).

After the one or more ribs 118 are formed from the placed UHPC, the top skin 120 of the top slab 104 and/or the bottom skin 122 of the bottom slab 106 may be formed. For example, the top skin 120 of the top slab 104 and/or the bottom skin 122 of the bottom slab 106 may be approximately one inch in thickness. By way of another example (e.g., as illustrated by the formwork 200 in FIGS. 2A and 2B), the top skin 120 of the top slab 104 and/or the bottom skin 122 of the bottom slab 106 may have additional material at each span edge 112 with a quantity that is greater than approximately one inch in thickness. For instance, the quantity of additional material at each span edge 112 may increase from one inch to three inches over a six-inch run.

It is noted herein, however, that the one or more ribs 118 and the top skin 120 and/or bottom skin 122 may be formed simultaneously or substantially simultaneously. Therefore, the above description should not be interpreted as a limitation on the scope of the disclosure but merely an illustration.

It is noted herein, however, that the arrangement of the rods 600 as illustrated in FIG. 6 is only an example, and that the arrangement of the rods 600 may be differ from that illustrated in FIG. 6. As such, the arrangement of the rods 600 is not limited to the example as illustrated in FIG. 6. Therefore, the above description should not be interpreted as a limitation on the scope of the disclosure but merely an illustration.

Figure 7:
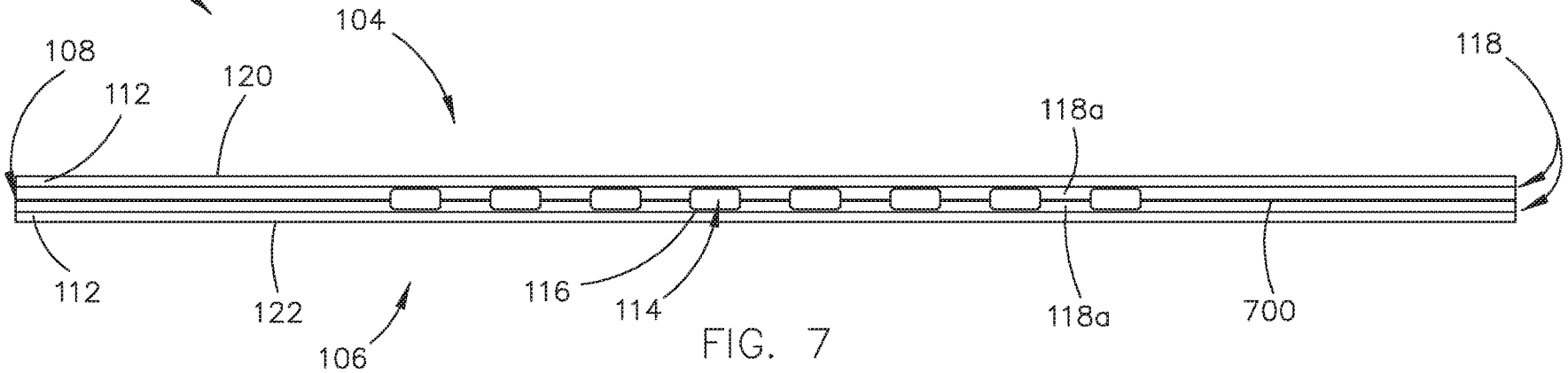
FIG. 7 illustrates an elevation view of an ultra high performance concrete (UHPC) voided slab panel, in accordance with one or more embodiments of the disclosure.

FIG. 7 illustrates the UHPC voided slab panel 102, in accordance with one or more embodiments of the disclosure.

The UHPC may be allowed to cure to a select hardness (e.g., a not fully set state) that is capable of holding shape. Once the amount of curing has reached the select threshold, the formwork 200 may be removed from the bottom slab 106. The sleeves or blockouts 210 may be filled with a quantity of material to secure the rods 600 and to provide a select (e.g., required minimum) interface shearing capacity. For example, the sleeves may be filled with additional UHPC, with a high-strength non-shrink (HSNS) grout, or the like. When the bottom slab 106 has fully set, or at least has a desired amount of connection to the top slab 104, the prestressing strands may be cut to de-tension the bottom slab 106. For example, the prestressing strand de-tensioning may require a compressive strength of at least 10,000 psi in the bottom slab 106, which may take on the order of one to three days.

The top slab 104 may then be lowered onto the bottom slab 106, such that the rods 600 within the bottom slab 106 may align with the holes 410 in the top slab 104 generated by the sleeves or blockouts 210 (or the holes 410 within the sleeves or blockouts 210), and the top slab 104 is released. It is noted herein the top slab 104 may be lowered onto the bottom slab 106 prior to or after the de-tensioning of the bottom slab 106. In addition, it is noted herein the one or more holes 410 may be configured to couple to the one or more rods 600 and/or may be configured to receive components configured to couple to the one or more rods 600.

During the joining of the top slab 104 onto the bottom slab 106, an 0.125-inch gap between the top slab 104 onto the bottom slab 106 may be filled with a joining material or joint material 700. For example, the joint material 700 may include an epoxy, plastic, cement raw material or cement mixed product, UHPC, or other material configured to securely join the top slab 104 and the bottom slab 106. The joint material 700 may be applied to the surfaces 404, 406 of the top slab 104 and the bottom slab 106, respectively.

It is noted herein that utility components (e.g., wires, pipes, ductwork, or the like) configured to transfer water utilities, power utilities, data utilities, heating, venting, and air conditioning (HVAC) utilities, or the like may then be inserted into the voids 110, 114 defined within the bottom slab 106 prior to the joining of the top slab 104. While the utilities may not need to be inserted at this stage (e.g., the utilities may be inserted following the joining of the top slab 104 and/or the installation of the UHPC voided slab panel 102 at a job site), but that inserting the utilities into the voids 110, 114 defined within the bottom slab 106 prior to the joining of the top slab 104 may greatly reduce job time.

Therefore, the above description should not be interpreted as a limitation on the scope of the disclosure but merely an illustration.

The top slab 104 and/or the bottom slab 106 may include one or more locations for lifting inserts to assist in the removal of the top slab 104 and/or the bottom slab 106 from the formwork 200 and/or the full UHPC voided slab panel 102 from the formwork 200 following the lowering of the top slab 104 onto the bottom slab 106 and subsequent setting. For example, a lifting insert may be positioned in the hole 410 (e.g., within the top slab 104 and the bottom slab 106, within the sleeves or blockouts 210*a*, 210*b*, or the like) at the midspan and in the hole 410 before the no-void sections of the one or more ribs 118. For instance, the lifting insert positioned in the hole 410 at the midspan and the lifting insert in positioned in the hole 410 before the no-void section of the ribs 118 may be separated by sixteen feet.

Although embodiments of the disclosure are directed to the top slab 104 and the bottom slab 106 being formed from the same formwork 200, it is noted herein the formwork 200 for the top slab 104 and the formwork 200 for the bottom slab 106 may be different (e.g., where the UHPC voided slab panel 102 is produced in experimental or research conditions). In addition, it is noted herein that the formwork 200 illustrated in FIGS. 2A and 2B is only an example, and that the formwork 200 may be fabricated with cut-outs, dimensions, or the like that differ from those illustrated in FIGS. 2A and 2B. As such, the formwork 200 is not limited to the exemplary embodiment as illustrated in FIGS. 2A and 2B. Therefore, the above description should not be interpreted as a limitation on the scope of the disclosure but merely an illustration.

Although embodiments of the disclosure as illustrated in FIGS. 1A-7 illustrate a mid-depth joint or joining surface between the top slab 104 and the bottom slab 106 of the UPHC voided slab panel 102, it is noted herein the joint or joining surface may be positioned closer to the top slab 104 and/or closer to the bottom slab 106.

FIGS. 8A-8E generally illustrate the UHPC voided slab panel 102, in accordance with one or more embodiments of the disclosure.

The top slab 104 may include the top skin 120 and one or more span edges 112. The bottom slab 104 may include the bottom skin 122, one or more span edges 112, and one or more ribs 118. The one or more ribs 118 may define one or more voids 110 (and one or more void portions 110*a*), and/or one or more voids 114. The one or more ribs 118 may include the entire rib structure (e.g., as opposed to a partial rib structure as generally illustrated in FIGS. 1A-7).

In one example, the one or more ribs 118 may be 20 inches tall, and may include one or more sections of varying widths through the height of 20 inches. For instance, the one or more ribs may have a section that changes from 10 inches wide to 2 inches wide along a height of 3.75 includes, may have a section that is 2 inches wide for a height of 1.125 inches, may have a section at least partially including an opening 800 that is 2 inches wide for a height of 10 inches, may have a section that is 2 inches wide for a height of 1.125 inches, may have a section that changes from 2 inches wide to 10 inches wide over a height of 2 inches, and may have a section that is 10 inches wide for a height of 2 inches.

Figure 8A:
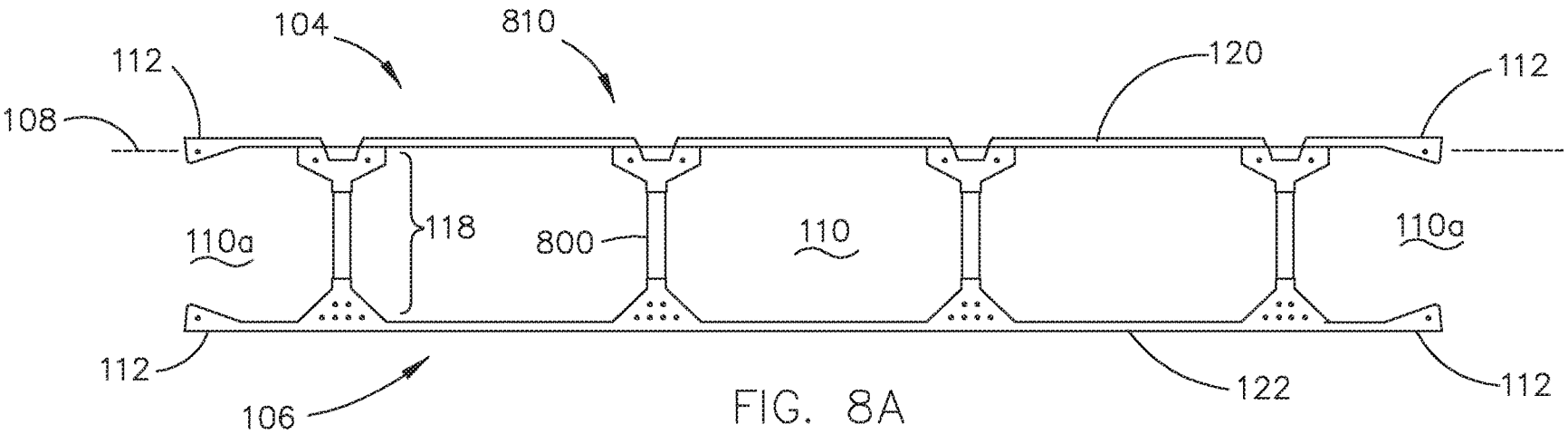
FIG. 8A illustrates an elevation view of an ultra high performance concrete (UHPC) voided slab panel, in accordance with one or more embodiments of the disclosure.
Figure 8B:
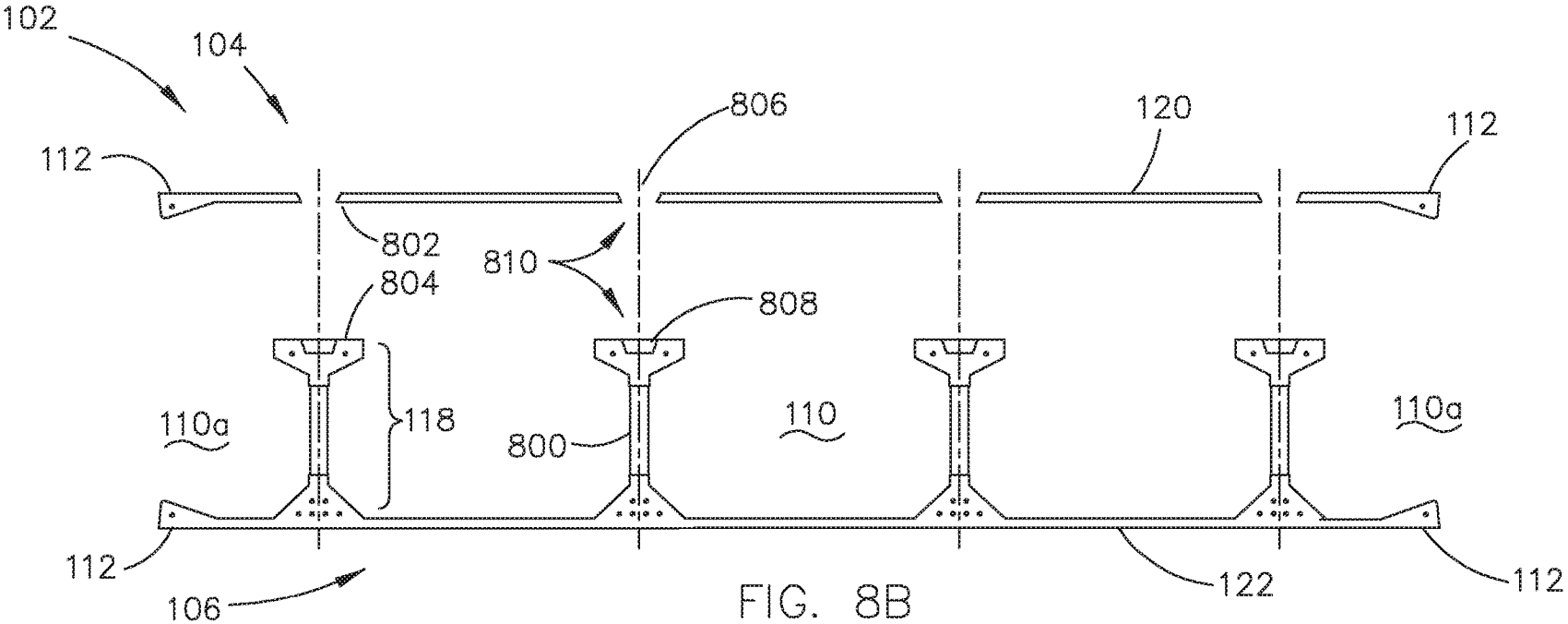
FIG. 8B illustrates an exploded elevation view of an ultra high performance concrete (UHPC) voided slab panel, in accordance with one or more embodiments of the disclosure.
Figure 8E:
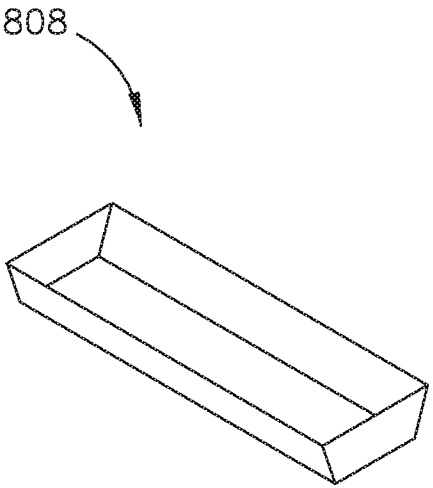
FIG. 8E illustrates a perspective view of a cut-out of an ultra high performance concrete (UHPC) voided slab panel, in accordance with one or more embodiments of the disclosure.
Figure 8D:
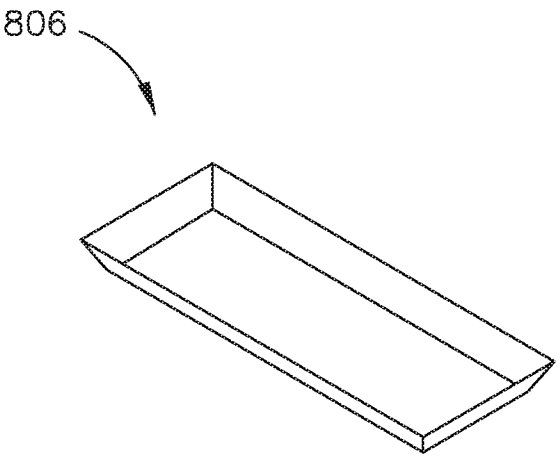
FIG. 8D illustrates a perspective view of a keyed structure of an ultra high performance concrete (UHPC) voided slab panel, in accordance with one or more embodiments of the disclosure.
Figure 8C:
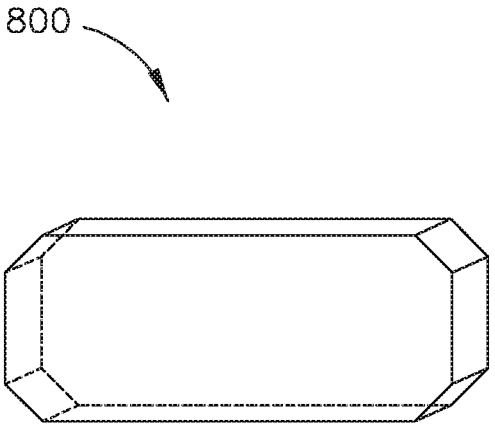
FIG. 8C illustrates a perspective view of a keyed structure of an ultra high performance concrete (UHPC) voided slab panel, in accordance with one or more embodiments of the disclosure.

As illustrated in FIG. 8C, the opening 800 may be 2 feet in length by 2 inches in width by 10 inches in height or thickness. The opening 800 may include a 2-inch chamfer between the length and height sides.

It is noted herein that the ribs 118 and the opening 800 as illustrated in FIGS. 8A-8C are only examples, and that the ribs 118 and the opening 800 may be fabricated with dimensions that differ from those illustrated in FIGS. 8A-8C. As such, the ribs 118 and the opening 800 are not limited to the examples as illustrated in FIGS. 8A-8C. Therefore, the above description should not be interpreted as a limitation on the scope of the disclosure but merely an illustration.

The joint 108 between the top slab 104 and the bottom slab 106 may be between a surface 802 of the top slab 104 and a surface 804 of the bottom slab 106. The joint 108 may be positioned nearly at the top of the UHPC voided slab panel 102 (e.g., as opposed to a mid-depth joint 108 as generally illustrated in FIGS. 1A-7).

The top slab 104 may include a first component 806 and the bottom slab 106 may include a second component 808 of a connector assembly 810. In general, the first component 806 and the second component 808 may include any respective cross-section.

For example, as illustrated in FIG. 8D, the first component 806 may include a trapezoidal cross-section. The first component 806 may be tapered, such that the such that the dimensions at the joint 108 are smaller than the dimensions at a select distance from the joint 108. For example, the dimensions at the joint 108 may be 12 inches by 4 inches, while the dimensions at the select distance from mid-depth may be 13 inches by 5 inches, where the select distance is 1.5 inches.

By way of another example, as illustrated in FIG. 8E, the second component 808 may include a trapezoidal cross-section. The one or more female keyed structures 402 may be tapered, such that the such that the dimensions at the joint 108 are larger than the dimensions at a select distance from the joint 108. For example, the dimensions at the joint 108 may be 12 inches by 4 inches, while the dimensions at the select distance from the joint 108 may be 11 inches by 3 inches, where the select distance is 1.5 inches It is noted herein that the first component 806 and the second component 808 as illustrated in FIGS. 8D and 8E are only examples, and that the first component 806 and the second component 808 may be fabricated with dimensions that differ from those illustrated in FIGS. 8D and 8E. As such, the first component 806 and the second component 808 are not limited to the examples as illustrated in FIGS. 8D and 8E. Therefore, the above description should not be interpreted as a limitation on the scope of the disclosure but merely an illustration.

The bottom slab 106 may be fabricated from UHPC. However, it is noted herein the top slab 104 may be fabricated from UHPC, cement board, plywood, raw wood, gypsum board, metal, or other material used in building and structure fabrication. Therefore, the above description should not be interpreted as a limitation on the scope of the disclosure but merely an illustration.

Figure 9A:
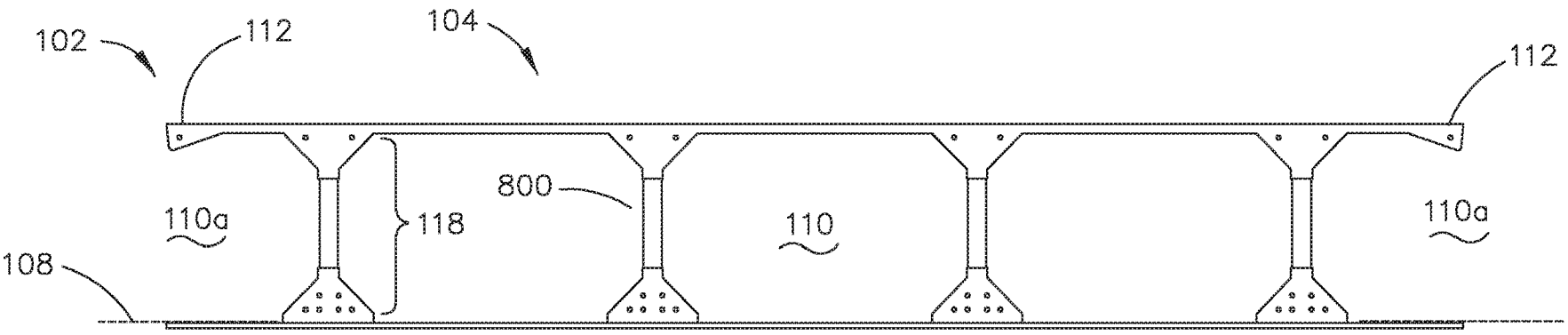
FIG. 9A illustrates an elevation view of an ultra high performance concrete (UHPC) voided slab panel, in accordance with one or more embodiments of the disclosure.
Figure 9B:
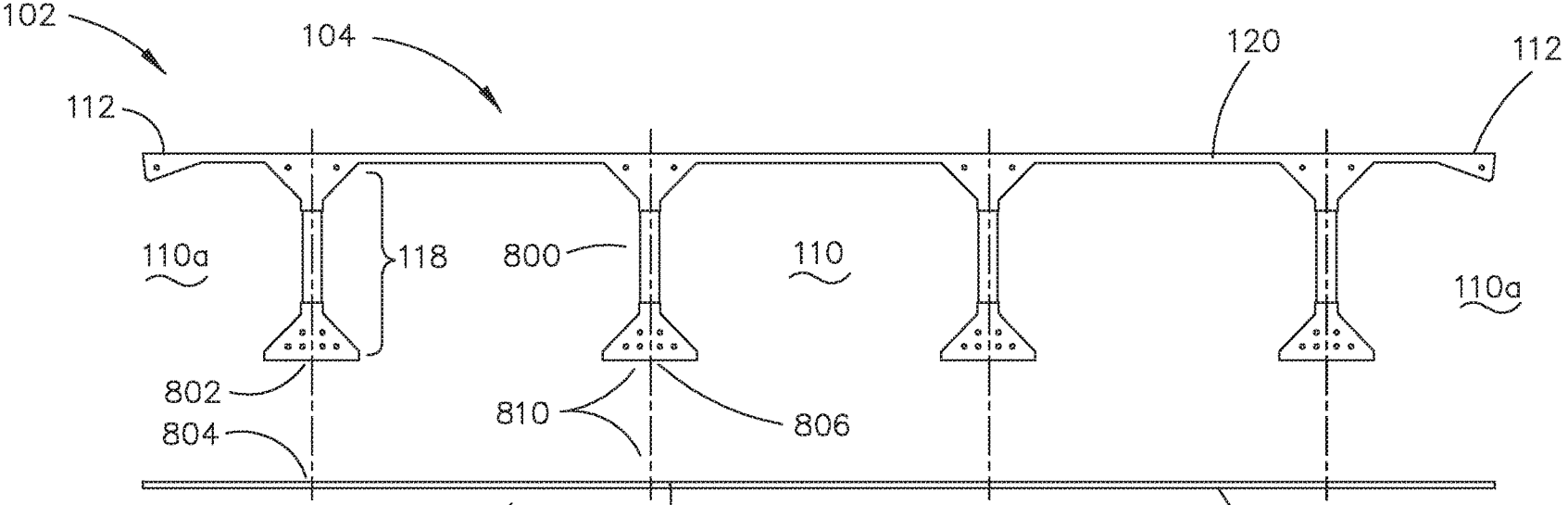
FIG. 9B illustrates an exploded elevation view of an ultra high performance concrete (UHPC) voided slab panel, in accordance with one or more embodiments of the disclosure.
Figure 9C:
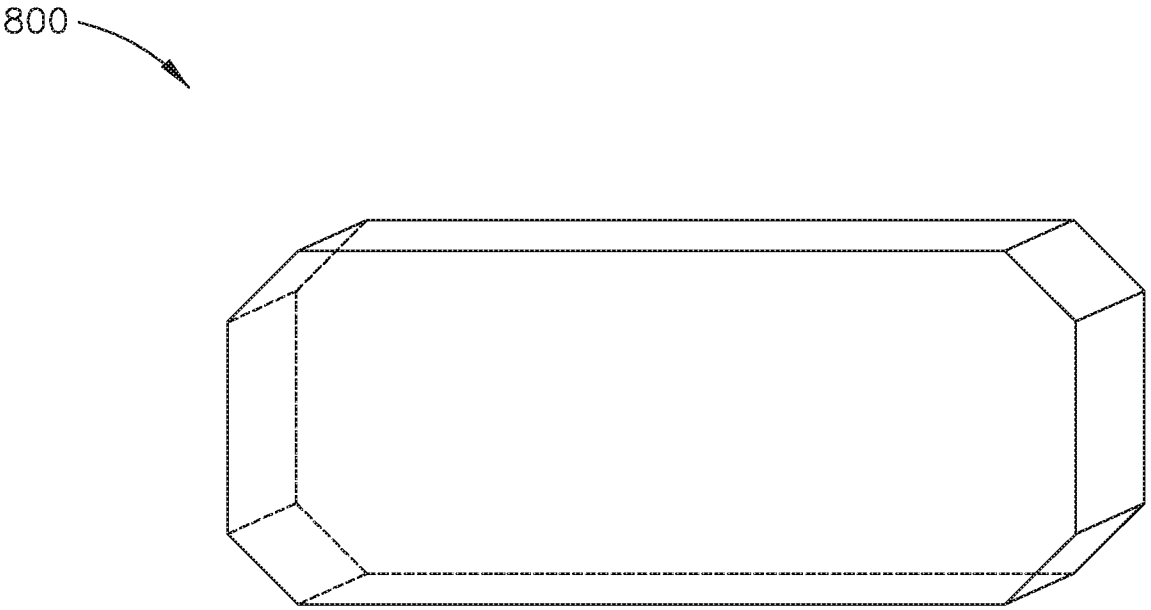
FIG. 9C illustrates a perspective view of a cut-out of an ultra high performance concrete (UHPC) voided slab panel, in accordance with one or more embodiments of the disclosure.

FIGS. 9A-9C generally illustrate the UHPC voided slab panel 102, in accordance with one or more embodiments of the disclosure.

The top slab 104 may include the top skin 120, one or more span edges 112, and one or more ribs 118. The one or more ribs 118 may define one or more voids 110 (and one or more void portion 110*a*), and/or one or more voids 114. The one or more ribs 118 may include the entire rib structure (e.g., as opposed to a partial rib structure as generally illustrated in FIGS. 1A-7). The bottom slab 104 may include the bottom skin 122.

In one example, the one or more ribs 118 may be 21 inches tall, and may include one or more sections of varying widths through the height of 20 inches. For instance, the one or more ribs may have a section that is 10 inches wide by 1 inch tall, a section that changes from 10 inches wide to 2 inches wide along a height of 3.75 inches, may have a section that is 2 inches wide for a height of 1.125 inches, may have a section at least partially including an opening 800 that is 2 inches wide for a height of 10 inches, may have a section that is 2 inches wide for a height of 1.125 inches, may have a section that changes from 2 inches wide to 10 inches wide over a height of 4 inches.

As illustrated in FIG. 9C, the opening 800 may be 2 feet in length by 2 inches in width by 10 inches in height or thickness. The opening 800 may include a 2-inch chamfer between the length and height sides. It is noted herein the opening 800 may form a portion of the one or more voids 114.

It is noted herein that the ribs 118 and the opening 800 as illustrated in FIGS. 9A-9C are only examples, and that the ribs 118 and the opening 800 may be fabricated with dimensions that differ from those illustrated in FIGS. 9A-9C. As such, the ribs 118 and the opening 800 are not limited to the examples as illustrated in FIGS. 9A-9C. Therefore, the above description should not be interpreted as a limitation on the scope of the disclosure but merely an illustration.

The joint 108 between the top slab 104 and the bottom slab 106 may be between a surface 802 of the top slab 104 and a surface 804 of the bottom slab 106. The joint 108 may be positioned nearly at the bottom of the UHPC voided slab panel 102 (e.g., as opposed to a mid-depth joint 108 as generally illustrated in FIGS. 1A-7).

The top slab 104 may be fabricated from UHPC. However, it is noted herein the bottom slab 106 may be fabricated from UHPC, cement board, plywood, raw wood, gypsum board, metal, or other material used in building and structure fabrication. Therefore, the above description should not be interpreted as a limitation on the scope of the disclosure but merely an illustration.

It is noted herein that the embodiments as generally illustrated in FIGS. 1A-7 may apply to the UHPC voided slab panel 102 and any components of the UHPC voided slab panel 102 as generally illustrated in FIGS. 8A-8E and/or FIGS. 9A-9C, to the extent the embodiments directed to FIGS. 1A-7 do not conflict with the embodiments directed to FIGS. 8A-8E and/or FIGS. 9A-9C, and vice versa. Therefore, the above description should not be interpreted as a limitation on the scope of the disclosure but merely an illustration.

Figure 10:
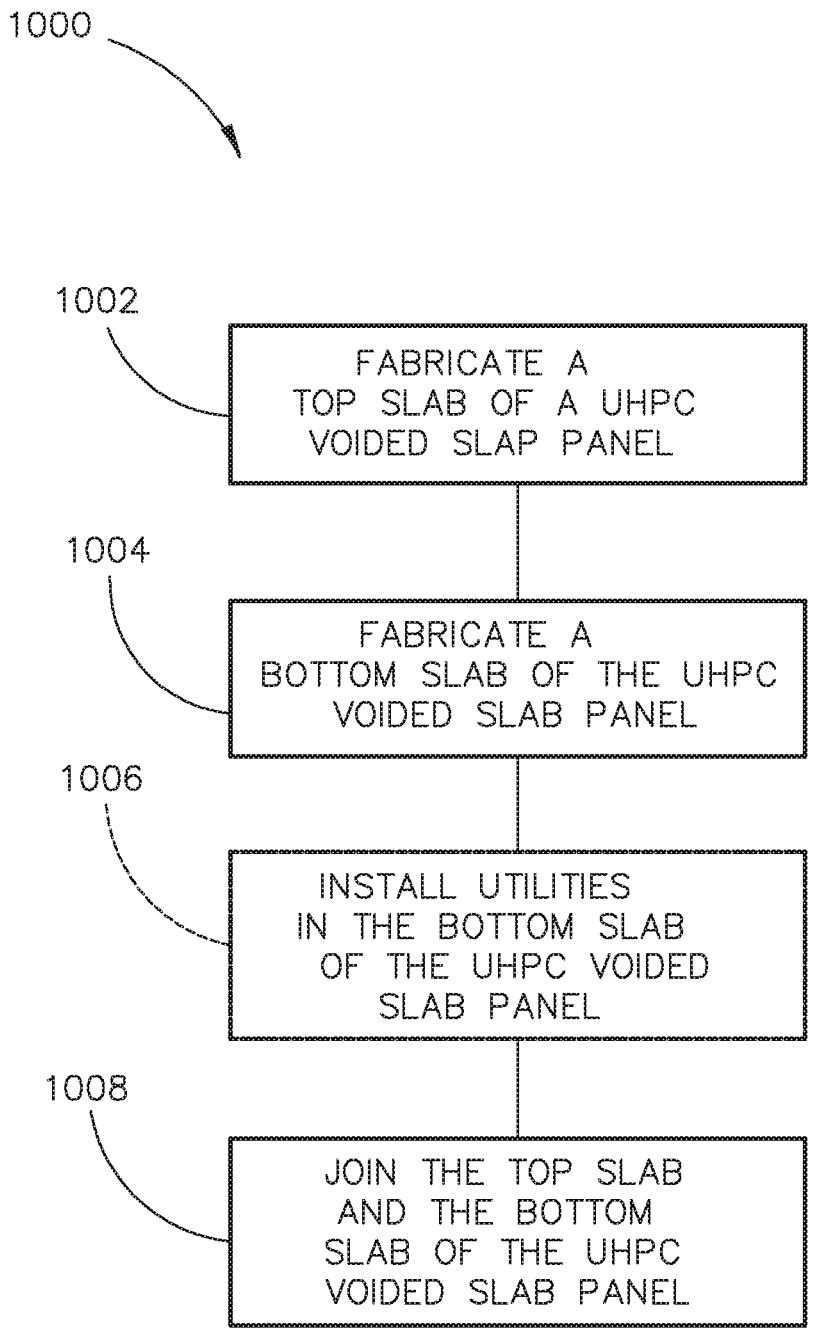
FIG. 10 illustrates a method for fabricating an ultra high performance concrete (UHPC) voided slab panel, in accordance with one or more embodiments of the disclosure.

FIG. 10 illustrates a method or process 1000 for manufacturing the UHPC voided slab panel 102, in accordance with one or more embodiments of the disclosure. It is noted herein the method or process 1000 may be understood as being illustrated in detail in FIGS. 2A-9C and the accompanying embodiments in the disclosure.

In a step 1002, a top slab of a UHPC voided slab panel may be fabricated. One or more prestressing strands may be pre-tensioned within the formwork 200. One or more sleeves or blockouts 210 may be inserted within the formwork 200. For example, the one or more sleeves or blockouts 210 may be removable. By way of another example, the one or more sleeves or blockouts 210 may be left in the top slab 104.

UHPC may be poured within the one or more rib portions 208 of the formwork 200 to form the one or more ribs 118. UHPC may be poured within the one or more skin portions 206 of the formwork 200 to form the top skin 120 and the one or more span edges 112 of the top slab 104. For example, the UHPC may be poured to form the top skin 120 and the one or more span edges 112 following a select amount of time to allow the one or more ribs 118 to set. It is noted herein, however, that UPHC may be poured for the one or more ribs 118, the top skin 120, and the one or more span edges 112 simultaneously or substantially simultaneously.

The top slab 104 may include one or more holes 410. For example, the one or more holes 410 may be formed by the removable sleeves or blockouts 210. By way of another example, the one or more holes 410 may be within the removable sleeves or blockouts 210 left in the top slab 104.

Following the pouring of the UHPC and after a select amount of time to allow for the one or more ribs 118, the top skin 120, and/or the one or more span edges 112 to set, the one or more prestressing strands may be de-tensioned and the top slab 104 may be removed.

In a step 1004, a bottom slab of a UHPC voided slab panel is fabricated. One or more prestressing strands may be pre-tensioned within the formwork 200. One or more sleeves or blockouts 210 may be inserted within the formwork 200. For example, the one or more sleeves or blockouts 210 may be removable. By way of another example, the one or more sleeves or blockouts 210 may be left in the top slab 104.

UHPC may be poured within the one or more rib portions 208 of the formwork 200 to form the one or more ribs 118. UHPC may be poured within the one or more skin portions 206 of the formwork 200 to form the bottom skin 122 and the one or more span edges 112 of the bottom slab 106. For example, the UHPC may be poured to form the bottom skin 122 and the one or more span edges 112 following a select amount of time to allow the one or more ribs 118 to set. It is noted herein, however, that UPHC may be poured for the one or more ribs 118, the bottom skin 122, and the one or more span edges 112 simultaneously or substantially simultaneously.

The bottom slab 106 may include one or more holes 410. For example, the one or more holes 410 may be formed by the removable sleeves or blockouts 210. By way of another example, the one or more holes 410 may be within the removable sleeves or blockouts 210 left in the bottom slab 106.

In a step 1006, utilities may be installed in the bottom slab of the UHPC voided slab panel. The utilities may be installed within the one or more voids 110 and/or the one or more voids 114 between the one or more ribs of the bottom slab 106.

It is noted herein, however, that step 1006 may be optional, as the utilities may be installed following step 1008 and/or during or following the installation of the UHPC voided slab panel 102 at the job site. Therefore, the above description should not be interpreted as a limitation on the scope of the disclosure but merely an illustration.

In a step 1008, the top slab and the bottom slab of the UHPC voided slab panel may be joined. Where the bottom slab 106 includes the one or more rods 600, the one or more rods 600 may be aligned within the one or more holes 410 within the top slab 104. The joint material 700 may be inserted in the joint 108 prior to the joining of the top slab 104 and the bottom slab 106.

Following the joining of the top slab 104 and the bottom slab 106 and after a select amount of time to allow for the joint material 700 to set, the one or more prestressing strands may be de-tensioned and the bottom slab 106 may be removed. It is noted herein, however, that the one or more prestressing strands may be de-tensioned and the bottom slab 106 may be removed following a select amount of time to allow the bottom skin 122 and the span edges 112 of the bottom slab 106 to set, prior to the joining with the top slab 104. Therefore, the above description should not be interpreted as a limitation on the scope of the disclosure but merely an illustration.

It is noted herein the method or process 1000 is not limited to the steps and/or sub-steps provided. The method or process 1000 may include more or fewer steps and/or sub-steps. The method or process 1000 may perform the steps and/or sub-steps simultaneously. The method or process 1000 may perform the steps and/or sub-steps sequentially, including in the order provided or an order other than provided. Therefore, the above description should not be interpreted as a limitation on the scope of the disclosure but merely an illustration.

In an exemplary embodiment, the finished UHPC voided slab panel 102 may by 60 feet by 12 feet by 22 inches in size. The finished UHPC voided slab panel 102 may weigh approximately 15 tons, or approximately 29,000 pounds, which is a much lighter weight than alternative, currently available products known in the art. The finished UHPC voided slab panel 102 may have a load rating of 100 pounds per square foot (lbs/sqft), which is a much higher strength rating than alternative, currently available products known in the art. It is noted herein this load rating is well in excess of the required ratings for apartment buildings and parking structures (e.g., 40 lbs/sqft) and commercial structures (e.g., 50 lbs/sqft).

Advantages of the disclosure include an ultra high performance concrete voided slab system including one or more ultra high performance concrete (UHPC) voided slab panels, where a voided slab panel includes a top slab and a bottom slab, where one or more voids are formed between the top slab and the bottom slab. Advantages of the disclosure are also directed to prestressing strands (or cables) embedded longitudinally in the top slab and/or the bottom slab to ensure adequate flexural (e.g., bending) capacity of the UHPC voided slab panel. Advantages of the disclosure also include using steel fibers instead of rebar and/or shearing reinforcements, resulting in a system that is easier to manufacture and is thinner than conventional concrete slabs.

One skilled in the art will recognize that the herein described components (e.g., operations), devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components (e.g., operations), devices, and objects should not be taken limiting.

Although a user is described herein as a single figure, those skilled in the art will appreciate that the user may be representative of a human user, a robotic user (e.g., computational entity), and/or substantially any combination thereof (e.g., a user may be assisted by one or more robotic agents) unless context dictates otherwise. Those skilled in the art will appreciate that, in general, the same may be said of "sender" and/or other entity-oriented terms as such terms are used herein unless context dictates otherwise.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, different other components. It is to be understood that such depicted architectures are merely exemplary, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled," to each other to achieve the desired functionality, and any two components capable of being so associated can also be viewed as being "operably couplable," to each other to achieve the desired functionality. Specific examples of operably couplable include but are not limited to physically mateable and/or physically interacting components.

In some instances, one or more components may be referred to herein as "configured to," "configurable to," "operable/operative to," "adapted/adaptable," "able to," "conformable/conformed to," or the like. Those skilled in the art will recognize that such terms (e.g., "configured to") can generally encompass active-state components and/or inactive-state components and/or standby-state components, unless context requires otherwise.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," or the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, or the like" is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, or the like). In those instances where a convention analogous to "at least one of A, B, or C, or the like" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, or the like). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

Although particular embodiments of this invention have been illustrated, it is apparent that various modifications and embodiments of the invention may be made by those skilled in the art without departing from the scope and spirit of the foregoing disclosure. Accordingly, the scope of the invention should be limited only by the claims appended hereto.

What is claimed:

1. An ultra high performance concrete (UHPC) voided slab panel, comprising:

a top slab including a top skin and a bottom slab including a bottom skin, the top slab and the bottom slab being joined at a joint positioned a select height within the UHPC voided slab panel, the joint being filled with a joint material during the joining of the top slab and the bottom slab, the top slab and the bottom slab being joined via a connector assembly; and at least two ribs, the at least two ribs defining at least one void, the at least one void being accessible via at least one opening within an exterior surface of the UHPC voided slab panel, the top slab and the bottom slab each being fabricated from UHPC and a plurality of embedded prestressing strands, the top slab and the bottom slab being joined via the connector assembly subsequent to at least the top slab being fabricated, the UHPC voided slab panel being configured to meet select strength requirements that are greater than select strength requirements for conventional precast concrete without reinforcing bars being embedded within the UHPC voided slab panel.

2. The panel in claim 1, the at least one void configured to house one or more utility components, the one or more utility components being configured to transfer one or more utilities through the UHPC voided slab panel.

3. The panel in claim 1, the at least one void being accessible via at least one opening within an exterior span surface of the UHPC voided slab panel or via at least one opening within an exterior width surface of the UHPC voided slab panel.

4. The panel in claim 1, the at least one void including a first void accessible via at least one opening within a span surface of a span of the UHPC voided slab panel and a second void accessible via at least one opening within a width surface of the UHPC voided slab panel.

5. The panel in claim 1, the select height being at mid-depth of the UHPC voided slab panel, a first portion of each of the at least two ribs being formed with the top slab and a corresponding second portion of each of the at least two ribs being formed with the bottom slab.

6. The panel in claim 5, the first portion of each of the at least two ribs and the corresponding second portion of each of the at least two ribs being coupled together via the connector assembly, the connector assembly including a keyed assembly with a male keyed structure and a female keyed structure, the male keyed structure configured to interlock with the female keyed structure, the male keyed structure configured to pass through a plane when interlocking with the female keyed structure, the plane being at mid-depth of the UHPC voided slab panel.

7. The panel in claim 6, a first portion of a first rib of the at least two ribs including a male keyed structure and a corresponding second portion of the first rib of the at least two ribs including a corresponding female keyed structure, a first portion of a second rib of the at least two ribs including a female keyed structure and a corresponding second portion of the second rib of the at least two ribs including a corresponding male keyed structure.

8. The panel in claim 1, the select height being proximate to the top slab of the UHPC voided slab panel.

9. The panel in claim 8, the at least two ribs being formed with the bottom slab.

10. The panel in claim 9, the top slab including a first component of the connector assembly, the at least two ribs formed with the bottom slab including a second component of the connector assembly.

11. The panel in claim 1, the select height being proximate to the bottom slab of the UHPC voided slab panel.

12. The panel in claim 11, the at least two ribs being formed with the top slab.

13. The panel in claim 12, the bottom slab including a first component of the connector assembly, the at least two ribs formed with the top slab including a second component of the connector assembly.

14. The panel in claim 1, the connector assembly including at least one rod in the bottom slab and at least one hole in the top slab, the at least one hole configured to receive the at least one rod when the top slab and the bottom slab are joined.

15. The panel in claim 14, the at least one rod configured to be inserted within the at least two ribs.

16. An ultra high performance concrete voided slab system, comprising:

a plurality of ultra high performance concrete (UHPC) voided slab panels, each UHPC voided slab panel of the plurality of UHPC voided slab panels comprising:

a top slab including a top skin and a bottom slab including a bottom skin, the top slab and the bottom slab being joined at a joint positioned a select height within the UHPC voided slab panel, the joint may be filled with a joint material during the joining of the top slab and the bottom slab, the top slab and the bottom slab being joined via a connector assembly; and at least two ribs, the at least two ribs defining at least one void, the at least one void being accessible via at least one opening within an exterior surface of the UHPC voided slab panel, the top slab and the bottom slab being fabricated from UHPC and a plurality of embedded prestressing strands, the top slab and the bottom slab being joined via the connector assembly subsequent to at least the top slab being fabricated, the UHPC voided slab panel being configured to meet select strength requirements that are greater than select strength requirements for conventional precast concrete without reinforcing bars being embedded within the UHPC voided slab panel.

17. The system in claim 16, each UHPC voided slab panel of the plurality of UHPC voided slab panels comprising:

a span edge on at least one of the top slab or the bottom slab, adjacent UHPC voided slab panels of the plurality of the UHPC voided slab panel being couplable together via adjacent span edges of the adjacent UHPC voided slab panels.

18. A method of making the panel in claim 1, the method comprising:

fabricating a top slab of an ultra high performance concrete (UHPC) voided slab panel with a top formwork, the fabricating the top slab comprising:

pouring a first amount of UHPC within at least two rib portions to fabricate at least two ribs, the space between the at least two ribs defining at least one void; and pouring a second amount of UHPC within at least one skin portion to fabricate a top skin, the top formwork including a plurality of prestressing strands positioned to be embedded during the pouring of the at least one of the first amount of UHPC or during the pouring of the second amount of UHPC;

fabricating a bottom slab of the UHPC voided slab panel with a bottom formwork, the fabricating the bottom slab comprising:

pouring a first amount of UHPC within at least two rib portions to fabricate at least two ribs, the space between the at least two ribs defining at least one void; and pouring a second amount of UHPC within at least one skin portion to fabricate a bottom skin, the bottom formwork including a plurality of prestressing strands positioned to be embedded during the pouring of the at least one of the first amount of UHPC or during the pouring of the second amount of UHPC; and joining the top slab of the UHPC voided slab panel and the bottom slab of the UHPC voided slab panel together via a connector assembly, the joint being filled with a joint material during the joining of the top slab and the bottom slab, the UHPC voided slab panel being configured to meet select strength requirements that are greater than select strength requirements for conventional precast concrete without reinforcing bars being embedded within the UHPC voided slab panel.

19. The method in claim 18, comprising:

installing one or more utility components within the at least one void, the one or more utility components being configured to transfer one or more utilities through the UHPC voided slab panel.

20. The method in claim 18, the top formwork and the bottom formwork being a single formwork, the top slab being fabricated before the bottom slab, the fabricated top slab being removed from the single formwork prior to the fabricating of the bottom slab.

* * * * *